US010861397B2

(12) United States Patent
Jeon et al.

(10) Patent No.: US 10,861,397 B2
(45) Date of Patent: Dec. 8, 2020

(54) ORGANIC LIGHT EMITTING DIODE DISPLAY DEVICE SUPPORTING A PARTIAL DRIVING MODE

(71) Applicant: Samsung Display Co., Ltd., Yongin-si (KR)

(72) Inventors: Jae-Hyeon Jeon, Seoul (KR); Jihye Kim, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/717,795

(22) Filed: Dec. 17, 2019

(65) Prior Publication Data

US 2020/0211469 A1 Jul. 2, 2020

(30) Foreign Application Priority Data

Dec. 28, 2018 (KR) ..... 10-2018-0171982

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2310/0202* (2013.01); *G09G 2320/02* (2013.01)

(58) Field of Classification Search
CPC ..... G09G 3/3266; G09G 3/3275; G09G 2310/0202; G09G 2320/02; G09G 3/3666
See application file for complete search history.

(56) References Cited

U.S. PATENT DOCUMENTS 6,522,319 B1 * 2/2003 Yamazaki ..... G09G 3/3622 345/103
6,900,788 B2 * 5/2005 Yamazaki ..... G09G 3/3696 345/103
7,079,103 B2 * 7/2006 Morita ..... G09G 3/3677 345/204
7,333,096 B2 * 2/2008 Washio ..... G09G 3/3648 345/103
7,999,800 B2 * 8/2011 Iwabuchi ..... G09G 3/3258 345/204

(Continued)

FOREIGN PATENT DOCUMENTS

KR 10-1872987 B1 7/2018

*Primary Examiner* — Michael Pervan
(74) *Attorney, Agent, or Firm* — Lewis Roca Rothgerber Christie LLP

(57) ABSTRACT

An OLED display device includes a display panel including first and second partial panel regions, a scan driver configured to sequentially apply scan signals to the first and second partial panel regions in a normal driving mode, and to sequentially apply the scan signals to a driven one of the first and second partial panel regions in a partial driving mode, and a data driver configured to apply data signals to the first and second partial panel regions in the normal driving mode, and to apply the data signals to the driven one of the first and second partial panel regions in the partial driving mode. In the partial driving mode, the scan driver is configured to sequentially apply diode initialization signals to the driven one of the first and second partial panel regions, and to concurrently apply the diode initialization signals to a non-driven one of the first and second partial panel regions.

20 Claims, 12 Drawing Sheets

(56) References Cited

U.S. PATENT DOCUMENTS

2002/0175887 A1* 11/2002 Yamazaki ..... G09G 3/36
345/87
2010/0026620 A1* 2/2010 Tanaka ..... G09G 3/3666
345/100

* cited by examiner

ORGANIC LIGHT EMITTING DIODE DISPLAY DEVICE SUPPORTING A PARTIAL DRIVING MODE

CROSS-REFERENCE TO RELATED APPLICATION

This application claims priority to and the benefit of Korean Patent Application No. 10-2018-0171982, filed on Dec. 28, 2018 in the Korean Intellectual Property Office (KIPO), the content of which is incorporated herein in its entirety by reference.

BACKGROUND

1. Field

Exemplary embodiments of the present inventive concept relate to display devices, and more particularly to organic light emitting diode (OLED) display devices supporting partial driving modes.

2. Description of the Related Art

An organic light emitting diode (OLED) display device is suitable for a flexible display device because the OLED display device does not require a backlight unit and has high flexibility. Recently, various flexible display devices, such as a foldable display device, a rollable display device, a stretchable display device, etc. have been developed. Among these various flexible display devices, the foldable display device provides portable convenience when it is folded and displays a large screen when it is unfolded, and therefore attracting much attention as next-generation technology in the display field.

In some foldable display devices, for example, in an out-folding display device, where a display panel is folded such that a portion of the display panel is located in the rear, a partial driving mode, where a partial panel region located in the front of the out-folding display device is driven and another (or remaining) partial panel region located in the rear of the out-folding display device is not driven may be used. However, even if data signals are not applied to the partial panel region that is not driven in the partial driving mode, the non-driven partial panel region may undesirably emit light due to remaining currents or leakage currents.

SUMMARY

Some example embodiments provide an organic light emitting diode (OLED) display device capable of preventing or reducing a partial panel region that is not driven in a partial driving mode from undesirably emitting light.

According to example embodiments, there is provided an OLED display device including a display panel including a first partial panel region and a second partial panel region, a scan driver configured to sequentially apply scan signals to the first and second partial panel regions in a normal driving mode where both of the first and second partial panel regions are driven, and to sequentially apply the scan signals to a driven one of the first and second partial panel regions in a partial driving mode, where the driven one of the first and second partial panel regions is driven and a non-driven one of the first and second partial panel regions is not driven, and a data driver configured to apply data signals to the first and second partial panel regions in the normal driving mode, and to apply the data signals to the driven one of the first and second partial panel regions in the partial driving mode. In the partial driving mode, the scan driver is configured to sequentially apply diode initialization signals to the driven one of the first and second partial panel regions, and to concurrently apply the diode initialization signals to the non-driven one of the first and second partial panel regions.

In example embodiments, in the partial driving mode, OLEDs of pixels included in the non-driven one of the first and second partial panel regions may be initialized in response to the concurrently applied diode initialization signals.

In example embodiments, in the partial driving mode, pixels included in the non-driven one of the first and second partial panel regions may form leakage current paths from a power supply voltage line to an initialization voltage line in response to the concurrently applied diode initialization signals.

In example embodiments, each of the first and second partial panel regions may include a plurality of pixels. Each of the plurality of pixels may include a diode initialization transistor having a gate for receiving a corresponding one of the diode initialization signals, a first terminal connected to an initialization voltage line, and a second terminal connected to an anode of an OLED. In the partial driving mode, the diode initialization transistors of the plurality of pixels included in the non-driven one of the first and second partial panel regions may be turned on in response to the concurrently applied diode initialization signals.

In example embodiments, the turned-on diode initialization transistors of the plurality of pixels included in the non-driven one of the first and second partial panel regions may form discharge paths for discharging parasitic capacitors of OLEDs of the plurality of pixels included in the non-driven one of the first and second partial panel regions to the initialization voltage line, and may form leakage current paths for allowing leakage currents of driving transistors to flow to the initialization voltage line.

In example embodiments, in the partial driving mode, the diode initialization signals applied to the non-driven one of the first and second partial panel regions may concurrently have an on-level for at least one horizontal time.

In example embodiments, in the partial driving mode, the diode initialization signals applied to the non-driven one of the first and second partial panel regions may sequentially have an on-level in a first frame period of the partial driving mode, and may be maintained as the on-level until a driving mode of the OLED display device is changed to the normal driving mode.

In example embodiments, the first partial panel region may include first through N-th pixel rows, the second partial panel region may include (N+1)-th through (N+M)-th pixel rows, and the scan signals may include first through (N+M)-th scan signals, where each of N and M is an integer greater than 1. The scan driver may include a first scan stage configured to apply the first scan signal to the first pixel row in response to a first scan start signal, second through N-th scan stages configured to apply the second through N-th scan signals to the second through N-th pixel rows in response to the first through (N−1)-th scan signals, a scan input control circuit configured to selectively output a second scan start signal or the N-th scan signal in response to a mode control signal, an (N+1)-th scan stage configured to apply the (N+1)-th scan signal to the (N+1)-th pixel row in response to an output signal of the scan input control circuit, and (N+2)-th through (N+M)-th scan stages configured to apply the (N+2)-th through (N+M)-th scan signals to the (N+2)-th through (N+M)-th pixel rows in response to the (N+1)-th through (N+M−1)-th scan signals.

In example embodiments, the scan input control circuit may include a first scan input control transistor configured to output the N-th scan signal received from the N-th scan stage in response to the mode control signal having an on-level in the normal driving mode, and a second scan input control transistor configured to output the second scan start signal in response to an inverted mode control signal having the on-level in the partial driving mode.

In example embodiments, in the normal driving mode, the mode control signal may have an on-level, the first scan start signal may include a scan start pulse in each frame period, and the second scan start signal may have an off-level. In the partial driving mode, when the first partial panel region is driven and the second partial panel region is not driven, the mode control signal may have the off-level, the first scan start signal may include the scan start pulse in each frame period, and the second scan start signal may have the off-level. In the partial driving mode, when the first partial panel region is not driven and the second partial panel region is driven, the mode control signal may have the off-level, the first scan start signal may have the off-level, and the second scan start signal may include the scan start pulse in each frame period.

In example embodiments, the first partial panel region may include first through N-th pixel rows, the second partial panel region may include (N+1)-th through (N+M)-th pixel rows, and the diode initialization signals may include first through (N+M)-th diode initialization signals, where each of N and M is an integer greater than 1. The scan driver may include a first diode initialization stage configured to apply the first diode initialization signal to the first pixel row in response to a first diode initialization start signal, second through N-th diode initialization stages configured to apply the second through N-th diode initialization signals to the second through N-th pixel rows in response to the first through (N−1)-th diode initialization signals, a diode initialization input control circuit configured to selectively output a second diode initialization start signal or the N-th diode initialization signal in response to a mode control signal, an (N+1)-th diode initialization stage configured to apply the (N+1)-th diode initialization signal to the (N+1)-th pixel row in response to an output signal of the diode initialization input control circuit, and (N+2)-th through (N+M)-th diode initialization stages configured to apply the (N+2)-th through (N+M)-th diode initialization signals to the (N+2)-th through (N+M)-th pixel rows in response to the (N+1)-th through (N+M−1)-th diode initialization signals.

In example embodiments, the diode initialization input control circuit may include a first diode initialization input control transistor configured to output the N-th diode initialization signal received from the N-th diode initialization stage in response to the mode control signal having an on-level in the normal driving mode, and a second diode initialization input control transistor configured to output the second diode initialization start signal in response to an inverted mode control signal having the on-level in the partial driving mode.

In example embodiments, in the normal driving mode, the mode control signal may have an on-level, the first diode initialization start signal may include a diode initialization start pulse in each frame period, and the second diode initialization start signal may have an off-level. In the partial driving mode, when the first partial panel region is driven and the second partial panel region is not driven, the mode control signal may have the off-level, the first diode initialization start signal may include the diode initialization start pulse in each frame period, and the second diode initialization start signal may have the on-level. In the partial driving mode, when the first partial panel region is not driven and the second partial panel region is driven, the mode control signal may have the off-level, the first diode initialization start signal may have the on-level, and the second diode initialization start signal may include the diode initialization start pulse in each frame period.

In example embodiments, the first through N-th diode initialization stages may operate in response to first and second diode initialization clock signals, and the (N+1)-th through (N+M)-th diode initialization stages may operate in response to third and fourth diode initialization clock signals. In the normal driving mode, the first and second diode initialization clock signals may have same phases as those of the third and fourth diode initialization clock signals, respectively. In the partial driving mode, when the first partial panel region is driven and the second partial panel region is not driven, the first and second diode initialization clock signals may periodically toggle between an on-level and an off-level, the third and fourth diode initialization clock signals may have the on-level, and the second diode initialization start signal may include a diode initialization start pulse in a first frame period of the partial driving mode. In the partial driving mode, when the first partial panel region is not driven and the second partial panel region is driven, the first and second diode initialization clock signals may have the on-level, the third and fourth diode initialization clock signals may periodically toggle between the on-level and the off-level, and the first diode initialization start signal may include the diode initialization start pulse in the first frame period of the partial driving mode.

According to example embodiments, there is provided an OLED display device including a display panel including a first partial panel region including first through N-th pixel rows and a second partial panel region including (N+1)-th through (N+M)-th pixel rows, where each of N and M is an integer greater than 1, a scan driver configured to sequentially apply scan signals to the first through (N+1)-th pixel rows in a normal driving mode where both of the first and second partial panel regions are driven, and to sequentially apply the scan signals to the (N+1)-th through (N+M)-th pixel rows in a partial driving mode where the first partial panel region is not driven and the second partial panel region is driven, and a data driver configured to apply data signals to the first through (N+M)-th pixel rows in the normal driving mode, and to apply the data signals to the (N+1)-th through (N+M)-th pixel rows in the partial driving mode where the first partial panel region is not driven and the second partial panel region is driven. In the normal driving mode, the scan driver is configured to sequentially apply diode initialization signals to the first through (N+M)-th pixel rows. In the partial driving mode where the first partial panel region is not driven and the second partial panel region is driven, the scan driver is configured to sequentially apply the diode initialization signals to the (N+1)-th through (N+M)-th pixel rows, and to concurrently apply the diode initialization signals to the first through N-th pixel rows.

In example embodiments, in the partial driving mode where the first partial panel region is not driven and the second partial panel region is driven, the scan signals and the data signals may not be applied to the first through N-th pixel rows.

In example embodiments, in the partial driving mode where the first partial panel region is not driven and the second partial panel region is driven, OLEDs of pixels included in the first partial panel region may be initialized in response to the concurrently applied diode initialization signals.

In example embodiments, in the partial driving mode where the first partial panel region is not driven and the second partial panel region is driven, pixels included in the first partial panel region may form leakage current paths from a power supply voltage line to an initialization voltage line in response to the concurrently applied diode initialization signals.

In example embodiments, in the partial driving mode where the first partial panel region is not driven and the second partial panel region is driven, the diode initialization signals applied to first partial panel region may sequentially have an on-level in a first frame period of the partial driving mode, and may be maintained as the on-level until a driving mode of the OLED display device is changed to the normal driving mode.

In example embodiments, in the partial driving mode where the first partial panel region is driven and the second partial panel region is not driven, the scan driver may sequentially apply the diode initialization signals to the first through N-th pixel rows, and may concurrently apply the diode initialization signals to the (N+1)-th through (N+M)-th pixel rows.

As described above, the OLED display device according to example embodiments may concurrently apply diode initialization signals to a partial panel region that is not driven in a partial driving mode, thereby forming, in pixels of the non-driven partial panel region, discharge paths for discharging parasitic capacitors of OLEDs and leakage current paths where leakage currents of driving transistors flow. Accordingly, the non-driven partial panel region may be prevented or reduced from undesirably emitting light.

BRIEF DESCRIPTION OF THE DRAWINGS

Illustrative, non-limiting example embodiments will be more clearly understood from the following detailed description in conjunction with the accompanying drawings.

DETAILED DESCRIPTION

Figure 1:
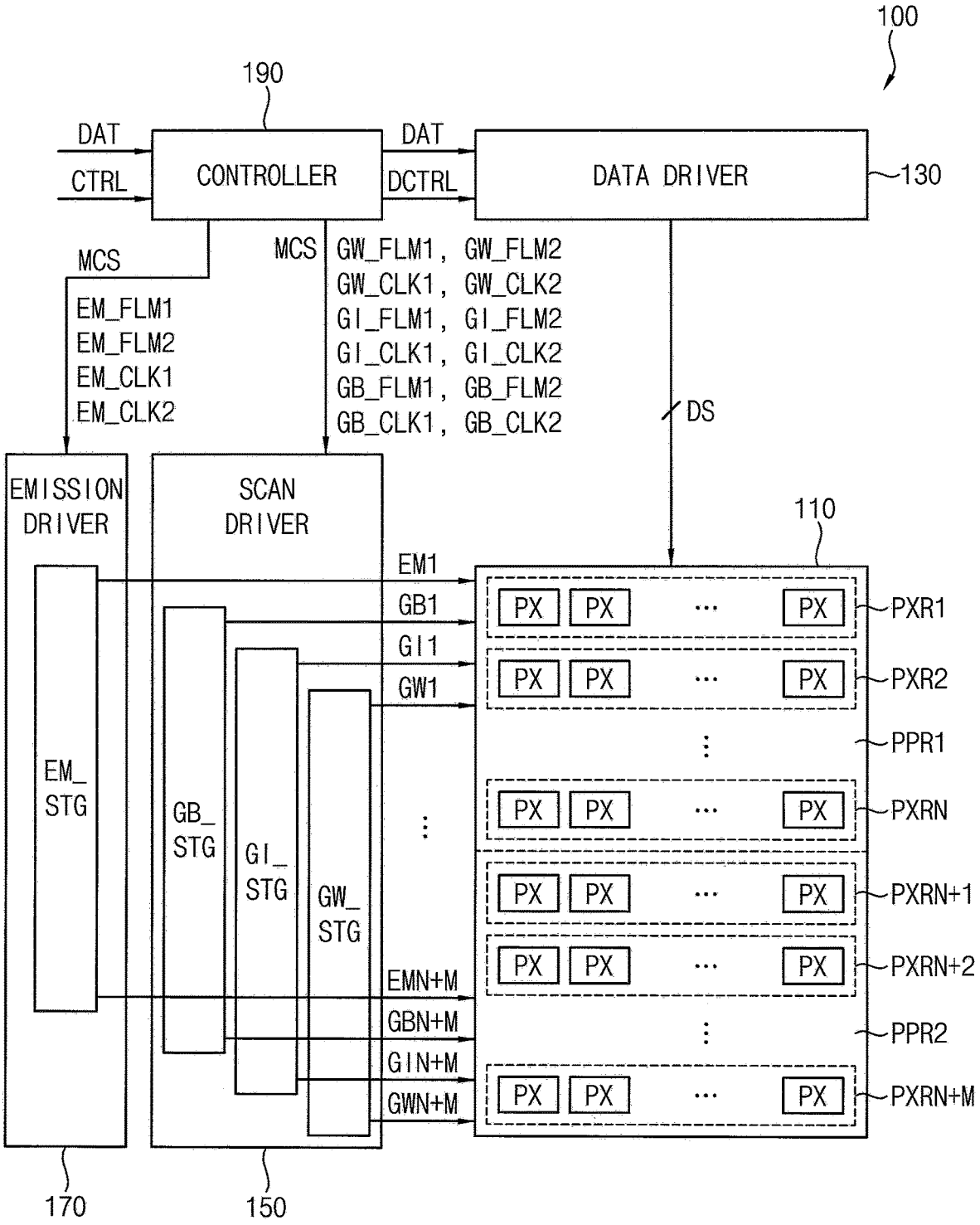
FIG. 1 is a block diagram illustrating an organic light emitting diode (OLED) display device according to example embodiments.

The example embodiments are described more fully hereinafter with reference to the accompanying drawings. Like or similar reference numerals refer to like or similar elements throughout.

Figure 2:
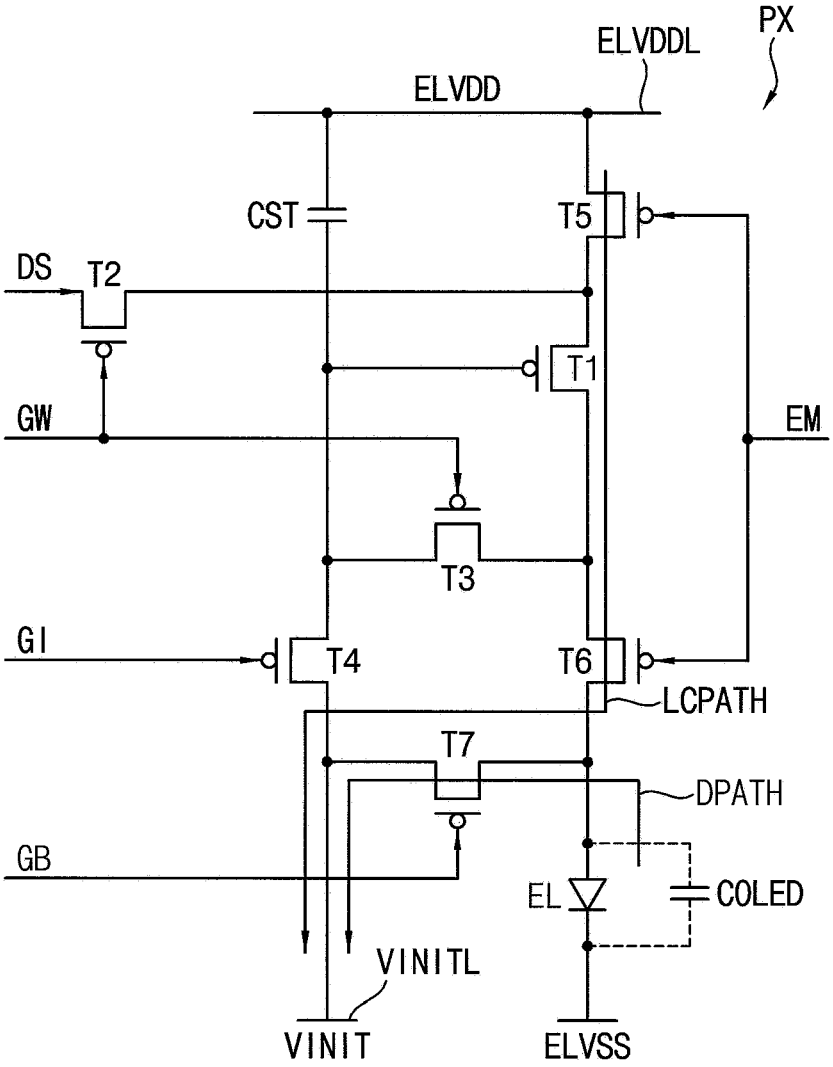
FIG. 2 is a circuit diagram illustrating an example of a pixel included in the OLED display device of FIG. 1.

FIG. 1 is a block diagram illustrating an organic light emitting diode (OLED) display device according to example embodiments, and FIG. 2 is a circuit diagram illustrating an example of a pixel included in the OLED display device of FIG. 1.

Referring to FIG. 1, an OLED display device 100 according to example embodiments may include a display panel 110, a data driver 130 that provides data signals DS to the display panel 110, a scan driver 150 that provides scan signals GW1 through GWN+M, gate initialization signals GI1 through GIN+M and diode initialization signals GB1 through GBN+M to the display panel 110, an emission driver 170 that provides emission control signals EM1 through EMN+M to the display panel 110, and a controller 190 that controls the data driver 130, the scan driver 150 and the emission driver 170.

The display panel 110 may include a plurality of data lines, a plurality of scan lines, a plurality of gate initialization lines, a plurality of diode initialization lines, a plurality of emission control lines, and a plurality of pixels PX connected thereto. The display panel 110 may be an OLED display panel where each pixel PX includes an OLED. In some example embodiments, the display panel 110 may be a flexible display panel, such as a foldable display panel, a rollable display panel, a stretchable display panel, etc.

Figure 7:
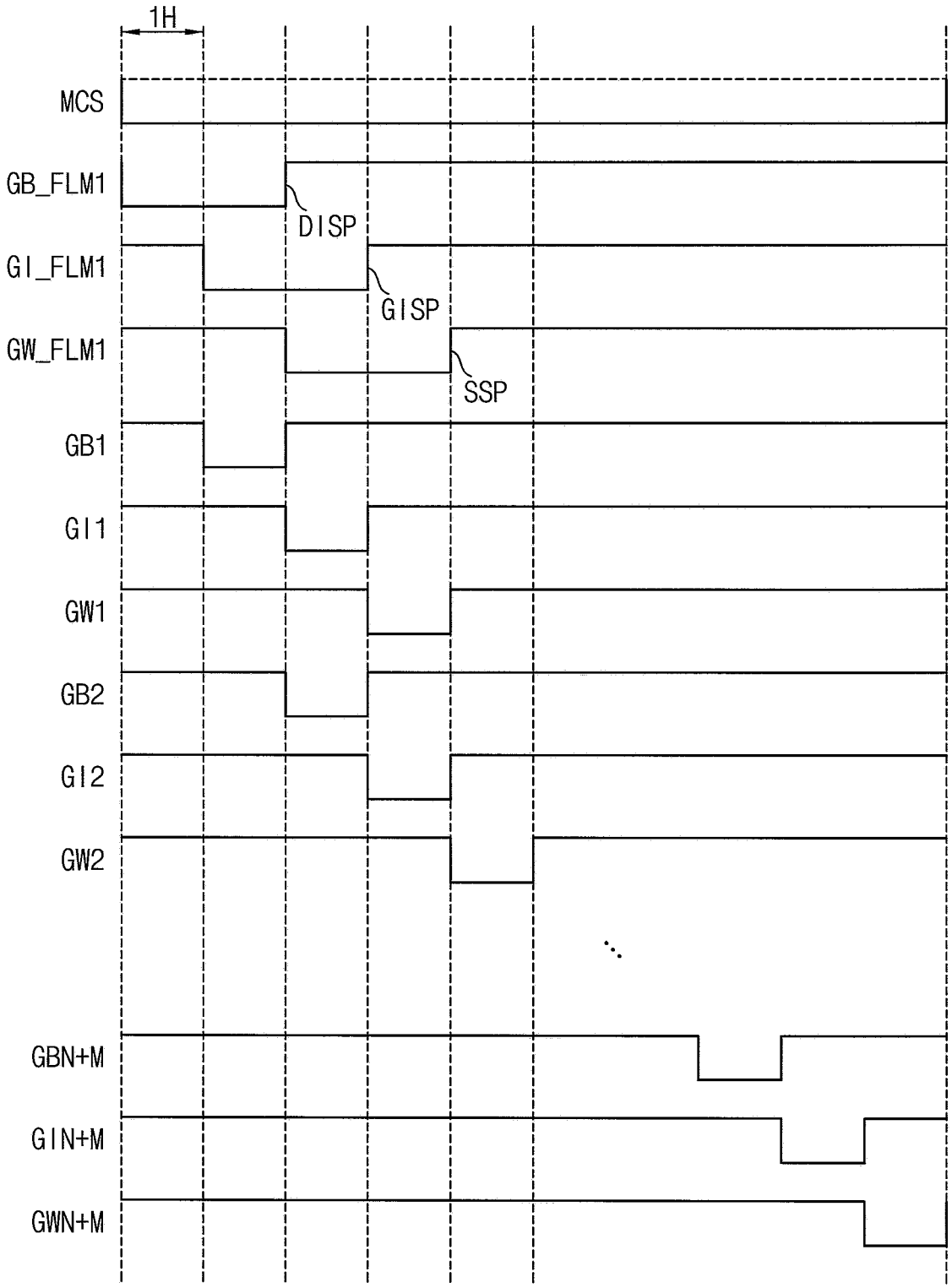
FIG. 7 is a timing diagram for describing an example of an operation of the OLED display device of FIG. 1 in a normal driving mode.

In some example embodiments, as illustrated in FIG. 2, each pixel PX may include a driving transistor T1, a switching transistor T2, a compensation transistor T3, a gate initialization transistor T4, a first emission transistor T5, a second emission transistor T6, a diode initialization transistor T7, a storage capacitor CST and an organic light emitting diode EL. The driving transistor T1 may generate a driving current based on a voltage stored in the storage capacitor CST. The switching transistor T2 may transfer a data signal DS to a source of the driving transistor T1 in response to a scan signal GW. The compensation transistor T3 may diode-connect the driving transistor T1 in response to the scan signal GW. The storage capacitor CST may be connected between a gate of the driving transistor T1 and a line ELVDDL of a first power supply voltage ELVDD. For example, when the scan signal GW is applied, a compensation voltage, where a negative threshold voltage of the driving transistor T1 is added to the data signal DS, may be applied to the storage capacitor CST through the diode-connected driving transistor T1. The gate initialization transistor T4 may apply an initialization voltage VINIT to the gate of the driving transistor T1 and the storage capacitor CST in response to a gate initialization signal GI. The gate of the driving transistor T1 and the storage capacitor CST may be initialized by the initialization voltage VINIT applied through the gate initialization transistor T4. The first emission transistor T5 may connect the first power supply voltage line ELVDDL to the source of the driving transistor T1 in response to an emission control signal EM, and the second emission transistor T6 may connect a drain of the driving transistor T1 to the organic light emitting diode EL in response to the emission control signal EM. For example, while the emission control signal EM is applied, the first and second emission transistors T5 and T6 may be turned on to form a path of the driving current from the first power supply voltage line ELVDDL through the first emission transistor T5, the driving transistor T1, the second emission transistor T6 and the organic light emitting diode EL to a line of a second power supply voltage ELVSS. The diode initialization transistor (e.g., a bypass transistor) T7 may connect a line VINITL of the initialization voltage VINIT to an anode of the organic light emitting diode EL and a drain of the second emission transistor T6 in response to a diode initialization signal (e.g., a bypass signal) GB. In some example embodiments, the diode initialization transistor T7 may have a gate for receiving the diode initialization signal GB, a first terminal connected to the initialization voltage line VINITL, and a second terminal connected to the anode of the organic light emitting diode EL. The organic light emitting diode EL may be connected between the second emission transistor T6 and the line of the second power supply voltage ELVSS. Although FIG. 7 illustrates an example of a pixel PX having a 7T1C structure including seven transistors T1 through T7 and one capacitor CST, the pixel PX included in the OLED display device 100 according to example embodiments may not be limited to the 7T1C structure. For example, a pixel PX may have any structure including the diode initialization transistor T7 that connects the initialization voltage line VINITL to the anode of the organic light emitting diode EL and a drain of the second emission transistor T6 in response to the diode initialization signal GB.

As illustrated in FIG. 1, the display panel 110 may include a plurality of partial panel regions PPR1 and PPR2. In a normal driving mode, all of the plurality of partial panel regions PPR1 and PPR2 may be driven. In a partial driving mode, a portion of the plurality of partial panel regions PPR1 and PPR2 may be driven, and the remainder of the plurality of partial panel regions PPR1 and PPR2 may not be driven. In some example embodiments, the display panel 110 may include a first partial panel region PPR1 including first through N-th pixel rows PXR1, PXR2, . . . , PXRN, and the second partial panel region PPR2 including (N+1)-th through (N+M)-th pixel rows PXRN+1, PXRN+2, . . . , PXRN+M, where each of N and M is an integer greater than 1. Here, each pixel row PXR1 through PXRN+M may be a series of pixels PX connected to the same scan line (and/or the same gate/diode initialization line). According to example embodiments, the pixels PX in the same pixel row may be located in the same position along a vertical direction (e.g., arranged along a gate line direction), or may be located in two or more positions along the vertical direction. For example, in a case where the plurality of pixels PX are arranged in a diamond shape, two adjacent pixels PX in the same pixel row may be located in different positions along the vertical direction. In the partial driving mode, one of the first and second partial panel regions PPR1 and PPR2 may be driven, and the other one of the first and second partial panel regions PPR1 and PPR2 may not be driven.

In an example embodiment, where the display panel 110 is a foldable display panel, and the display panel 110 is folded such that the first partial panel region PPR1 is located in the rear of the OLED display device 100, the first partial panel region PPR1 may not be driven and the second partial panel region PPR2 may be driven in the partial driving mode. Although FIG. 1 illustrates an example where the display panel 110 is divided into two partial panel regions PPR1 and PPR2, the number of the partial panel regions may not be limited thereto.

The data driver 130 may provide the data signals DS to the plurality of pixels PX based on image data DAT and a data control signal DCTRL received from the controller 190. In some example embodiments, the data control signal DCTRL may include, but not limited to, a horizontal start signal and a load signal. In the normal driving mode where both of the first and second partial panel regions PPR1 and PPR2 are driven, the data driver 130 may apply the data signals DS to the first and second partial panel regions PPR1 and PPR2. In the partial driving mode where one of the first and second partial panel regions PPR1 and PPR2 is driven and the other one of the first and second partial panel regions PPR1 and PPR2 is not driven, the data driver 130 may apply the data signals DS to the driven one of the first and second partial panel regions PPR1 and PPR2, and may not apply the data signals DS to the non-driven one of the first and second partial panel regions PPR1 and PPR2. For example, in the partial driving mode where the first partial panel region PPR1 is not driven and the second partial panel region PPR2 is driven, the data driver 130 may not apply the data signals DS to the first through N-th pixel rows PXR1 through PXRN, and may apply the data signals DS to the (N+1)-th through (N+M)-th pixel rows PXRN+1 through PXRN+M.

The scan driver 150 may sequentially provide the scan signals GW1 through GWN+M, the gate initialization signals GI1 through GIN+M and the diode initialization signals GB1 through GBN+M on a pixel row basis based on a scan control signal received from the controller 190. In some example embodiments, the scan control signal may include, but is not limited to, a mode control signal MCS, first and second scan start signals GW_FLM1 and GW_FLM2, first and second scan clock signals GW_CLK1 and GW_CLK2, first and second gate initialization start signals GI_FLM1 and GI_FLM2, first and second gate initialization clock signals GI_CLK1 and GI_CLK2, first and second diode initialization start signals GB_FLM1 and GB_FLM2, and first and second diode initialization clock signals GB_CLK1 and GB_CLK2. In the normal driving mode where both of the first and second partial panel regions PPR1 and PPR2 are driven, the scan driver 150 may sequentially provide the scan signals GW1 through GWN+M, the gate initialization signals GI1 through GIN+M and the diode initialization signals GB1 through GBN+M to the first and second partial panel regions PPR1 and PPR2 on a pixel row basis. In the partial driving mode where one of the first and second partial panel regions PPR1 and PPR2 is driven and the other one of the first and second partial panel regions PPR1 and PPR2 is not driven, the scan driver 150 may sequentially apply the scan signals (e.g., GWN+1 through GWN+M), the gate initialization signals (e.g., GIN+1 through GIN+M) and the diode initialization signals (e.g., GBN+1 through GBN+M) to the driven one (e.g., PPR2) of the first and second partial panel regions PPR1 and PPR2, and may not apply the scan signals (e.g., GW1 through GWN) and the gate initialization signals (e.g., GI1 through GIN) to the non-driven one (e.g., PPR1) of the first and second partial panel regions PPR1 and PPR2. However, in the partial driving mode, the scan driver 150 may concurrently (e.g., substantially simultaneously) apply the diode initialization signals (e.g., GB1 through GBN) to the non-driven one (e.g., PPR1) of the first and second partial panel regions PPR1 and PPR2.

In some example embodiments, as illustrated in FIG. 1, the scan driver 150 may include a plurality of scan stages GW_STG for sequentially outputting the scan signals GW1 through GWN+M, a plurality of gate initialization stages GI_STG for sequentially outputting the gate initialization signals GI1 through GIN+M, and a plurality of diode initialization stages GB_STG for sequentially outputting the diode initialization signals GB1 through GBN+M. For example, based on the mode control signal MCS, the first and second scan start signals GW_FLM1 and GW_FLM2 and the first and second scan clock signals GW_CLK1 and GW_CLK2, the plurality of scan stages GW_STG may sequentially output the first through (N+M)-th scan signals GW1 through GWN+M to the first through (N+M)-th pixel rows PXR1 through PXRN+M in the normal driving mode, and may sequentially output a portion (e.g., GWN+1 through GWN+M) of the first through (N+M)-th scan signals GW1 through GWN+M to a portion (e.g., PXRN+1 through PXN+M) of the first through (N+M)-th pixel rows PXR1 through PXRN+M in the partial driving mode. Based on the mode control signal MCS, the first and second gate initialization start signals GI_FLM1 and GI_FLM2 and the first and second gate initialization clock signals GI_CLK1 and GI_CLK2, the plurality of gate initialization stages GI_STG may sequentially output the first through (N+M)-th gate initialization signals GI1 through GIN+M to the first through (N+M)-th pixel rows PXR1 through PXRN+M in the normal driving mode, and may sequentially output a portion (e.g., GIN+1 through GIN+M) of the first through (N+M)-th gate initialization signals GI1 through GIN+M to a portion (e.g., PXRN+1 through PXN+M) of the first through (N+M)-th pixel rows PXR1 through PXRN+M in the partial driving mode. Based on the mode control signal MCS, the first and second diode initialization start signals GB_FLM1 and GB_FLM2 and the first and second diode initialization clock signals GB_CLK1 and GB_CLK2, the plurality of diode initialization stages GB_STG may sequentially output the first through (N+M)-th diode initialization signals GB1 through GBN+M to the first through (N+M)-th pixel rows PXR1 through PXRN+M in the normal driving mode. In the partial driving mode, the plurality of diode initialization stages GB_STG may sequentially apply the diode initialization signals (e.g., GBN+1 through GBN+M) to the driven one (e.g., PPR2) of the first and second partial panel regions PPR1 and PPR2, and may concurrently (e.g., substantially simultaneously) apply the diode initialization signals (e.g., GB1 through GBN) to the non-driven one (e.g., PPR1) of the first and second partial panel regions PPR1 and PPR2. Although FIG. 1 illustrates an example where the scan signal GW, the gate initialization signal GI and the diode initialization signal GB are output by different stages GW_STG, GI_STG and GB_STG, in some example embodiments, at least two of the scan signal GW, the gate initialization signal GI, and the diode initialization signal GB may be output by the same stage. For example, the scan signal GW for a previous pixel row may be used as the gate initialization signal GI. In this case, the scan driver 150 may include only the scan stage GW_STG and the diode initialization stage GB_STG, and may not include the gate initialization stage GI_STG.

The emission driver 170 may provide the emission control signals EM1 through EMN+M to the plurality of pixels PX based on an emission driver control signal received from the controller 190. In some example embodiments, the emission driver control signal may include, but is not limited to, the mode control signal MCS, first and second emission control start signals EM_FLM1 and EM_FLM2 and first and second emission control clock signals EM_CLK1 and EM_CLK2. In some example embodiments, in the normal driving mode, the emission driver 170 may sequentially apply the emission control signals EM1 through EMN+M to the first and second partial panel regions PPR1 and PPR2 on a pixel row basis, and thus the first through (N+M)-th pixel rows PXR1 through PXRN+M may sequentially emit light. In the partial driving mode, the emission driver 170 may apply the emission control signals (e.g., EMN+1 through EMN+M) to the driven one (e.g., PPR2) of the first and second partial panel regions PPR1 and PPR2, and may not apply the emission control signals (e.g., EM1 through EMN) to the non-driven one (e.g., PPR1) of the first and second partial panel regions PPR1 and PPR2. In some example embodiments, the emission driver 170 may include a plurality of emission control stages EM_STG for sequentially outputting the emission control signals EM1 through EMN+M.

Although FIG. 1 illustrates an example where the scan driver 150 and the emission driver 170 are located at one side of the display panel 110, in some example embodiments, the scan driver 150 and the emission driver 170 may be located at both sides of the display panel 110.

The controller (e.g., a timing controller) 190 may receive the image data DAT and a control signal CTRL from an external host (e.g., a graphic processing unit (GPU) or a graphic card). In some example embodiments, the control signal CTRL may include, but not limited to, a main clock signal, a vertical synchronization signal, a horizontal synchronization signal, a data enable signal, etc. The controller 190 may control the data driver 130 by providing the image data DAT and the data control signal DCTRL to the data driver 130, may control the scan driver 150 by providing the mode control signal MCS, the start signals GW_FLM1, GW_FLM2, GI_FLM1, GI_FLM2, GB_FLM1 and GB_FLM2 and the clock signal GW_CLK1, GW_CLK2, GI_CLK1, GI_CLK2, GB_CLK1, and GB_CLK2 to the scan driver 150, and may control the emission driver 170 by providing the mode control signal MCS, the first and second emission control start signals EM_FLM1 and EM_FLM2, and first and second emission control clock signals EM_CLK1 and EM_CLK2 to the emission driver 170.

In the partial driving mode, even if the data signals DS are not applied to the non-driven partial panel region, the non-driven partial panel region may undesirably emit light due to remaining currents or leakage currents. For example, in a pixel PX of the non-driven partial panel region, remaining currents caused by the data signal DS in a previous frame period may exist in a parasitic capacitor COLED (e.g., as shown in FIG. 2) of an organic light emitting diode EL, and thus the pixel PX may undesirably emit light by the remaining currents in the parasitic capacitor COLED even if the pixel PX is not driven. Further, even if the pixel PX is not driven, a leakage current of a driving transistor T1 (and emission transistors T5 and T6) may flow from a power supply voltage line ELVDDL to the organic light emitting diode EL, and thus the pixel PX may undesirably emit light by the leakage current.

However, in the OLED display device 100 according to example embodiments, the scan driver 150 may concurrently (e.g., substantially simultaneously) apply the diode initialization signals (e.g., GB1 through GBN) to the non-driven partial panel region (e.g., PPR1) in the partial driving mode. Here, that the scan driver 150 concurrently (e.g., substantially simultaneously) applies the diode initialization signals (e.g., GB1 through GBN) to the non-driven partial panel region (e.g., PPR1) may mean that the scan driver 150 applies the diode initialization signals (e.g., GB1 through GBN) concurrently (e.g., substantially simultaneously) having an on-level (e.g., a low level) for more than a set or predetermined time to the non-driven partial panel region (e.g., PPR1). In some example embodiments, in the partial driving mode, the diode initialization signals (e.g., GB1 through GBN) applied to the non-driven partial panel region (e.g., PPR1) may concurrently (e.g., substantially simultaneously) have the on-level for at least one horizontal time. In other example embodiments, in the partial driving mode, the diode initialization signals (e.g., GB1 through GBN) applied to the non-driven partial panel region (e.g., PPR1) may sequentially have the on-level in a first frame period of the partial driving mode, and may be maintained as the on-level until a driving mode of the OLED display device 100 is changed to the normal driving mode.

In the partial driving mode, once the diode initialization signals (e.g., GB1 through GBN) are concurrently (e.g., substantially simultaneously) applied to the non-driven partial panel region (e.g., PPR1), the organic light emitting diodes EL of the pixels PX in the non-driven partial panel region (e.g., PPR1) may be initialized in response to the concurrently (e.g., simultaneously) applied diode initialization signals (e.g., GB1 through GBN). Further, in the partial driving mode, the pixels PX in the non-driven partial panel region (e.g., PPR1) may form leakage current paths LCPATH from the power supply voltage line ELVDDL to the initialization voltage line VINITL in response to the concurrently (e.g., simultaneously) applied diode initialization signals (e.g., GB1 through GBN). For example, in the partial driving mode, the diode initialization transistors T7 of the pixels PX in the non-driven partial panel region (e.g., PPR1) may be turned on in response to the concurrently (e.g., simultaneously) applied diode initialization signals (e.g., GB1 through GBN). The turned-on diode initialization transistors T7 of the pixels PX in the non-driven partial panel region (e.g., PPR1) may form discharge paths DPATH for discharging the parasitic capacitors COLED of the organic light emitting diodes EL to the initialization voltage line VINITL, and may form leakage current paths LCPATH for allowing the leakage currents of the driving transistors T1 (and the emission transistors T5 and T6) to flow to the initialization voltage line VINITL. Accordingly, the remaining currents in the parasitic capacitors COLED of the organic light emitting diodes EL may be removed through the discharge paths DPATH, the leakage currents of the driving transistors T1 (and the emission transistors T5 and T6) may be prevented or reduced by the leakage current paths LCPATH from being applied to the organic light emitting diodes EL, and thus the undesirable light emission of the pixels PX in the non-driven partial panel region (e.g., PPR1) caused by the remaining currents and the leakage currents may be prevented or reduced.

As described above, the OLED display device 100 according to example embodiments may concurrently (e.g., simultaneously) apply the diode initialization signals (e.g., GB1 through GBN) to the non-driven partial panel region (e.g., PPR1) in the partial driving mode, thereby forming the discharge paths DPATH for discharging the parasitic capacitors COLED of the organic light emitting diodes EL and the leakage current paths LCPATH for allowing the leakage currents of the driving transistors T1 to flow in the pixels PX of the non-driven partial panel region (e.g., PPR1). Accordingly, the undesirable light emission of the non-driven partial panel region (e.g., PPR1) may be prevented or reduced.

Figure 3:
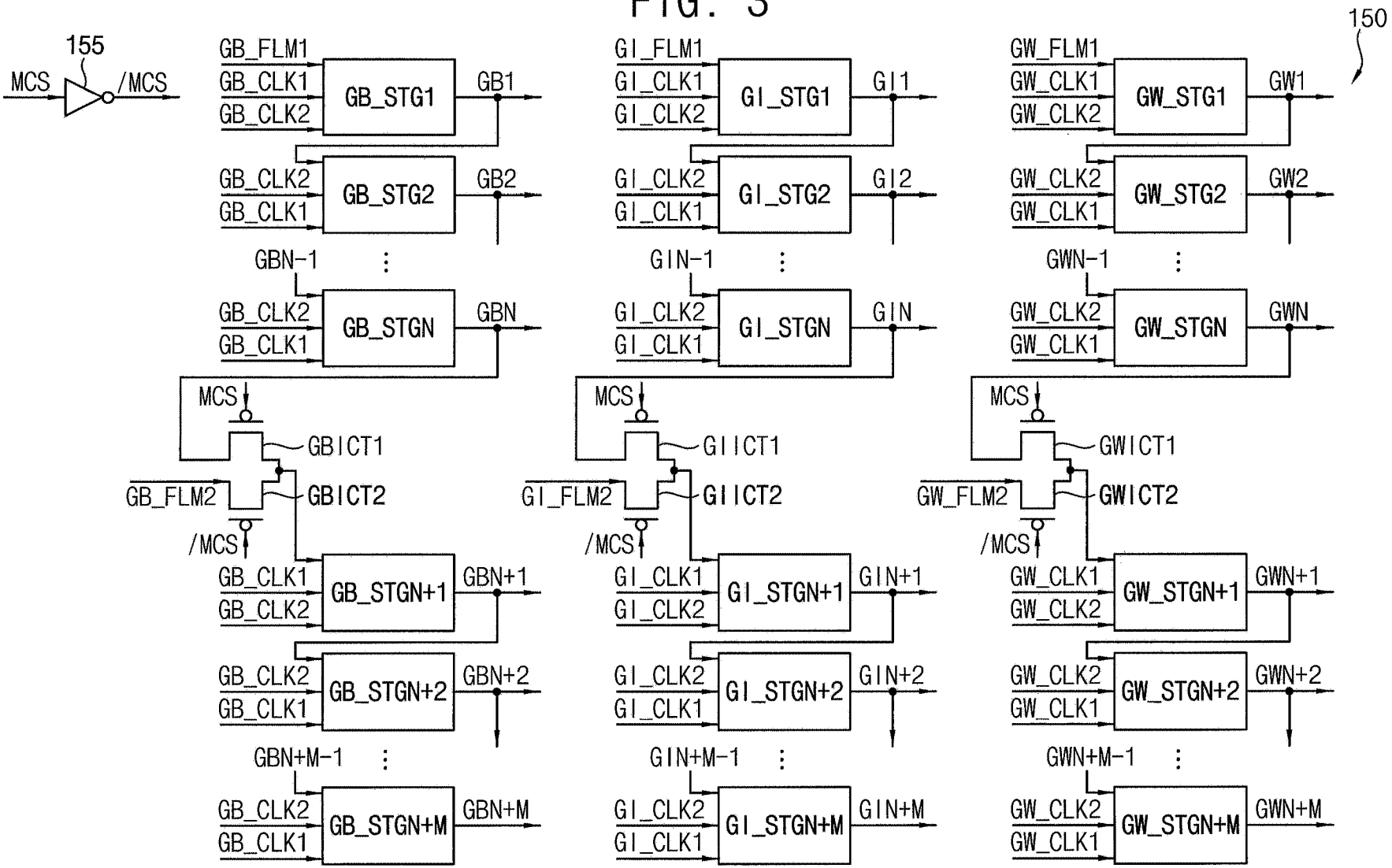
FIG. 3 is a block diagram illustrating an example of a scan driver included in the OLED display device of FIG. 1.
Figure 4:
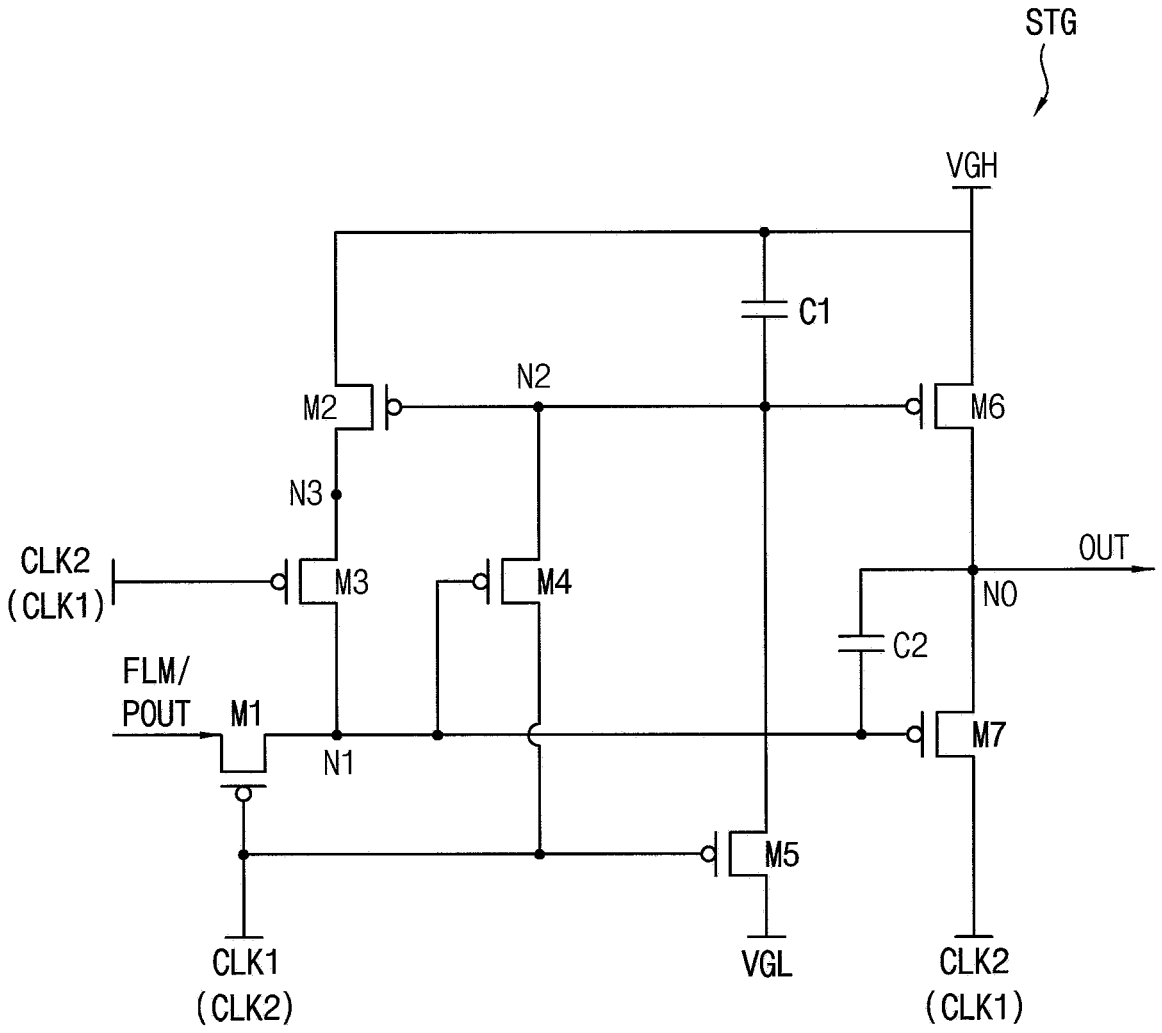
FIG. 4 is a circuit diagram illustrating an example of each stage included in the scan driver of FIG. 3.

FIG. 3 is a block diagram illustrating an example of a scan driver included in the OLED display device of FIG. 1, and FIG. 4 is a circuit diagram illustrating an example of each stage included in the scan driver of FIG. 3.

Referring to FIG. 1 and FIG. 3, a scan driver 150 may include first through (N+M)-th scan stages GW_STG1 through GW_STGN+M, a scan input control circuit including GWICT1 and GWICT2, first through (N+M)-th gate initialization stages GI_STG1 through GI_STGN+M, a gate initialization input control circuit GIICT1 and GIICT2, first through (N+M)-th diode initialization stages GB_STG1 through GB_STGN+M, a diode initialization input control circuit GBICT1 and GBICT2, and an inverter 155 outputting an inverted mode control signal /MCS.

The first through (N+M)-th scan stages GW_STG1 through GW_STGN+M may sequentially apply the first through (N+M)-th scan signals GW1 through GWN+M to first through (N+M)-th pixel rows PXR1 through PXRN+M based on first and second scan start signals GW_FLM1 and GW_FLM2 and first and second scan clock signals GW_CLK1 and GW_CLK2. In some example embodiments, the first and second scan clock signals GW_CLK1 and GW_CLK2 may have opposite phases to each other. In some example embodiments, odd-numbered scan stages (e.g., GW_STG1, GW_STGN+1, etc.) may output the scan signals (e.g., GW1, GWN+1, etc.) in response to the second scan clock signal GW_CLK2, and even-numbered scan stages (e.g., GW_STG2, GW_STGN, GW_STGN+2, GW_STGN+M, etc.) may output the scan signals (e.g., GW2, GWN, GWN+2, GWN+M, etc.) in response to the first scan clock signal GW_CLK1. In some example embodiments, as illustrated in FIG. 4, each stage STG of the first through (N+M)-th scan stages GW_STG1 through GW_STGN+M may include first through seventh transistors M1 through M7 and first and second capacitors C1 and C2. In a case where the stage STG of FIG. 4 is one of the first through (N+M)-th scan stages GW_STG1 through GW_STGN+M, a start signal FLM may be the first scan start signal GW_FLM1 or the second scan start signal GW_FLM2, a previous output signal POUT may be a previous scan signal, an output signal OUT may be a scan signal, a first clock signal CLK1 may be the first scan clock signal GW_CLK1, and a second clock signal CLK2 may be the second scan clock signal GW_CLK2.

For example, in each stage STG of the first through (N+M)-th scan stages GW_STG1 through GW_STGN+M, the first transistor M1 may transfer the start signal FLM or the previous output signal POUT to a first node N1 in response to the first clock signal CLK1 (or the second clock signal CLK2 in case of the even-numbered scan stage), the second transistor M2 may transfer a high gate voltage VGH to a third node N3 in response to a voltage of a second node N2, the third transistor M3 may transfer a voltage of the third node N3 to the first node N1 in response to the second clock signal CLK2 (or the first clock signal CLK1 in case of the even-numbered scan stage), the fourth transistor M4 may transfer the first clock signal CLK1 (or the second clock signal CLK2 in case of the even-numbered scan stage) to the second node N2 in response to a voltage of the first node N1, the fifth transistor M5 may transfer a low gate voltage VGL to the second node N2 in response to the first clock signal CLK1 (or the second clock signal CLK2 in case of the even-numbered scan stage), the sixth transistor M6 may output the high gate voltage VGH as the output signal OUT to an output node NO in response to the voltage of the second node N2, and the seventh transistor M7 may output the second clock signal CLK2 (or the first clock signal CLK1 in case of the even-numbered scan stage) as the output signal OUT to the output node NO in response to the voltage of the first node N1. Further, the first capacitor C1 may be connected between a line of the high gate voltage VGH and the second node N2, and the second capacitor C2 may be connected between the first node N1 and the output node NO. Although FIG. 4 illustrates an example of a configuration of each stage STG of FIG. 4, each scan stage GW_STG1 through GW_STGN+M of the scan driver 150 according to example embodiments may not be limited to the configuration of FIG. 4.

In some example embodiments, the first scan stage GW_STG1 may apply the first scan signal GW1 to the first pixel row PXR1 in response to the first scan start signal GW_FLM1, and the second through N-th scan stages GW_STG2 through GW_STGN may apply the second through N-th scan signals GW2 through GWN to the second through N-th pixel rows PXR2 through PXRN in response to a previous scan signal, or the first through (N−1)-th scan signals GW through GWN−1.

The scan input control circuit GWICT1 and GWICT2 may selectively output the second scan start signal GW_FLM2 or the N-th scan signal GWN in response to a mode control signal MCS. The scan input control circuit GWICT1 and GWICT2 may output the N-th scan signal GWN when the mode control signal MCS represents a normal driving mode, or when the mode control signal MCS has an on-level, and may output the second scan start signal GW_FLM2 when the mode control signal MCS represents a partial driving mode, or when the mode control signal MCS has an off-level. In some example embodiments, the scan input control circuit GWICT1 and GWICT2 may include a first scan input control transistor GWICT1 that outputs the N-th scan signal GWN received from the N-th scan stage GW_STGN in response to the mode control signal MCS having the on-level in the normal driving mode, and a second scan input control transistor GWICT2 that outputs the second scan start signal GW_FLM2 in response to the inverted mode control signal/MCS having the on-level in the partial driving mode.

The (N+1)-th scan stage GW_STGN+1 may apply the (N+1)-th scan signal GWN+1 to the (N+1)-th pixel row PXRN+1 in response to an output signal (i.e., the second scan start signal GW_FLM2 or the N-th scan signal GWN) of the scan input control circuit GWICT1 and GWICT2. The (N+2)-th through (N+M)-th scan stages GW_STGN+2 through GW_STGN+M may apply the (N+2)-th through (N+M)-th scan signals GWN+2 through GWN+M to the (N+2)-th through (N+M)-th pixel rows PXRN+2 through PXRN+M in response to a previous scan signal, or the (N+1)-th through (N+M−1)-th scan signals GWN+1 through GWN+M−1.

In the normal driving mode, the mode control signal MCS may have the on-level, the first scan start signal GW_FLM1 may include a scan start pulse in each frame period, and the second scan start signal GW_FLM2 may have the off-level. Accordingly, the scan input control circuit GWICT1 and GWICT2 may output the N-th scan signal GWN, and the first through (N+M)-th scan stages GW_STG1 through GW_STGN+M may sequentially apply the first through (N+M)-th scan signals GW1 through GWN+M to the first through (N+M)-th pixel rows PXR1 through PXRN+M.

In the partial driving mode, when a first partial panel region PPR1 is driven and a second partial panel region PPR2 is not driven, the mode control signal MCS may have the off-level, the first scan start signal GW_FLM1 may include the scan start pulse in each frame period, and the second scan start signal GW_FLM2 may have the off-level. In this case, the first through N-th scan stages GW_STG1 through GW_STGN may sequentially apply the first through N-th scan signals GW1 through GWN to the first through N-th pixel rows PXR1 through PXRN in response to the first scan start signal GW_FLM1 in each frame period. Although the scan input control circuit GWICT1 and GWICT2 outputs the second scan start signal GW_FLM2, because the second scan start signal GW_FLM2 has the off-level, the (N+1)-th through (N+M)-th scan stages GW_STGN+1 through GW_STGN+M may not apply the (N+1)-th through (N+M)-th scan signals GWN+1 through GWN+M to the (N+1)-th through (N+M)-th pixel rows PXRN+1 through PXRN+M.

In the partial driving mode, when the first partial panel region PPR1 is not driven and the second partial panel region PPR2 is driven, the mode control signal MCS may have the off-level, the first scan start signal GW_FLM1 may have the off-level, and the second scan start signal GW_FLM2 may include the scan start pulse in each frame period. In this case, because the first scan start signal GW_FLM1 has the off-level, the first through N-th scan stages GW_STG1 through GW_STGN may not apply the first through N-th scan signals GW1 through GWN to the first through N-th pixel rows PXR1 through PXRN. The scan input control circuit GWICT1 and GWICT2 may output the second scan start signal GW_FLM2, and the (N+1)-th through (N+M)-th scan stages GW_STGN+1 through GW_STGN+M may sequentially apply the (N+1)-th through (N+M)-th scan signals GWN+1 through GWN+M to the (N+1)-th through (N+M)-th pixel rows PXRN+1 through PXRN+M in response to the second scan start signal GW_FLM2 in each frame period.

The first through (N+M)-th gate initialization stages GI_STG1 through GI_STGN+M may sequentially apply the first through (N+M)-th gate initialization signals GI1 through GIN+M to the first through (N+M)-th pixel rows PXR1 through PXRN+M based on first and second gate initialization start signals GI_FLM1 and GI_FLM2 and first and second gate initialization clock signals GI_CLK1 and GI_CLK2. In some example embodiments, the first and second gate initialization clock signals GI_CLK1 and GI_CLK2 may have opposite phases to each other. In some example embodiments, odd-numbered gate initialization stages (e.g., GI_STG1, GI_STGN+1, etc.) may output the gate initialization signals (e.g., GI1, GIN+1, etc.) in response to the second gate initialization clock signal GI_CLK2, and even-numbered gate initialization stages (e.g., GI_STG2, GI_STGN, GI_STGN+2, GI_STGN+M, etc.) may output the gate initialization signals (e.g., GI2, GIN, GIN+2, GIN+M, etc.) in response to the first gate initialization clock signal GI_CLK1. In some example embodiments, as illustrated in FIG. 4, each stage STG of the first through (N+M)-th gate initialization stages GI_STG1 through GI_STGN+M may include, but is not limited to, the first through seventh transistors M1 through M7 and the first and second capacitors C1 and C2.

The gate initialization input control circuit GIICT1 and GIICT2 may include a first gate initialization input control transistor GIICT1 that outputs the N-th gate initialization signal GIN received from the N-th gate initialization stage GI_STGN in response to the mode control signal MCS having the on-level in the normal driving mode, and a second gate initialization input control transistor GIICT2 that outputs the second gate initialization start signal GI_FLM2 in response to the inverted mode control signal /MCS having the on-level in the partial driving mode.

In the normal driving mode, the mode control signal MCS may have the on-level, the first gate initialization start signal GI_FLM1 may include a gate initialization start pulse in each frame period, and the second gate initialization start signal GI_FLM2 may have the off-level. Accordingly, the gate initialization input control circuit GIICT1 and GIICT2 may output the N-th gate initialization signal GIN, and the first through (N+M)-th gate initialization stages GI_STG1 through GI_STGN+M may sequentially apply the first through (N+M)-th gate initialization signals GI1 through GIN+M to the first through (N+M)-th pixel rows PXR1 through PXRN+M.

In the partial driving mode, when the first partial panel region PPR1 is driven and the second partial panel region PPR2 is not driven, the mode control signal MCS may have the off-level, the first gate initialization start signal GI_FLM1 may include the gate initialization start pulse in each frame period, and the second gate initialization start signal GI_FLM2 may have the off-level. In this case, the first through N-th gate initialization stages GI_STG1 through GI_STGN may sequentially apply the first through N-th gate initialization signals GI1 through GIN to the first through N-th pixel rows PXR1 through PXRN in each frame period, and the (N+1)-th through (N+M)-th gate initialization stages GI_STGN+1 through GI_STGN+M may not apply the (N+1)-th through (N+M)-th gate initialization signals GIN+1 through GIN+M to the (N+1)-th through (N+M)-th pixel rows PXRN+1 through PXRN+M.

In the partial driving mode, when the first partial panel region PPR1 is not driven and the second partial panel region PPR2 is driven, the mode control signal MCS may have the off-level, the first gate initialization start signal GI_FLM1 may have the off-level, and the second gate initialization start signal GI_FLM2 may include the gate initialization start pulse in each frame period. In this case, the first through N-th gate initialization stages GI_STG1 through GI_STGN may not apply the first through N-th gate initialization signals GI1 through GIN to the first through N-th pixel rows PXR1 through PXRN, and the (N+1)-th through (N+M)-th gate initialization stages GI_STGN+1 through GI_STGN+M may sequentially apply the (N+1)-th through (N+M)-th gate initialization signals GIN+1 through GIN+M to the (N+1)-th through (N+M)-th pixel rows PXRN+1 through PXRN+M in each frame period.

The first through (N+M)-th diode initialization stages GB_STG1 through GB_STGN+M may sequentially apply the first through (N+M)-th diode initialization signals GB1 through GBN+M to the first through (N+M)-th pixel rows PXR1 through PXRN+M based on first and second diode initialization start signals GB_FLM1 and GB_FLM2 and first and second diode initialization clock signals GB_CLK1 and GB_CLK2. In some example embodiments, the first and second diode initialization clock signals GB_CLK1 and GB_CLK2 may have opposite phases to each other. In some example embodiments, odd-numbered diode initialization stages (e.g., GB_STG1, GB_STGN+1, etc.) may output the diode initialization signals (e.g., GB1, GBN+1, etc.) in response to the second diode initialization clock signal GB_CLK2, and even-numbered diode initialization stages (e.g., GB_STG2, GB_STGN, GB_STGN+2, GB_STGN+M, etc.) may output the diode initialization signals (e.g., GB2, GBN, GBN+2, GBN+M, etc.) in response to the first diode initialization clock signal GB_CLK1. In some example embodiments, as illustrated in FIG. 4, each stage STG of the first through (N+M)-th diode initialization stages GB_STG1 through GB_STGN+M may include, but not limited to, the first through seventh transistors M1 through M7 and the first and second capacitors C1 and C2.

The diode initialization input control circuit GBICT1 and GBICT2 may include a first diode initialization input control transistor GBICT1 that outputs the N-th diode initialization signal GBN received from the N-th diode initialization stage GB_STGN in response to the mode control signal MCS having the on-level in the normal driving mode, and a second diode initialization input control transistor GBICT2 that outputs the second diode initialization start signal GB_FLM2 in response to the inverted mode control signal /MCS having the on-level in the partial driving mode.

In the normal driving mode, the mode control signal MCS may have the on-level, the first diode initialization start signal GB_FLM1 may include a diode initialization start pulse in each frame period, and the second diode initialization start signal GB_FLM2 may have the off-level. Accordingly, the diode initialization input control circuit GBICT1 and GBICT2 may output the N-th diode initialization signal GBN, and the first through (N+M)-th diode initialization stages GB_STG1 through GB_STGN+M may sequentially apply the first through (N+M)-th diode initialization signals GB1 through GBN+M to the first through (N+M)-th pixel rows PXR1 through PXRN+M.

In the partial driving mode, when the first partial panel region PPR1 is driven and the second partial panel region PPR2 is not driven, the mode control signal MCS may have the off-level, the first diode initialization start signal GB_FLM1 may include the diode initialization start pulse in each frame period, and the second diode initialization start signal GB_FLM2 may have the on-level. In this case, the first through N-th diode initialization stages GB_STG1 through GB_STGN may sequentially apply the first through N-th diode initialization signals GB1 through GBN to the first through N-th pixel rows PXR1 through PXRN in each frame period. Because the diode initialization input control circuit GBICT1 and GBICT2 outputs the second diode initialization start signal GB_FLM2, and the second diode initialization start signal GB_FLM2 has the on-level, the (N+1)-th through (N+M)-th diode initialization stages GB_STGN+1 through GB_STGN+M may provide the (N+1)-th through (N+M)-th pixel rows PXRN+1 through PXRN+M with the (N+1)-th through (N+M)-th diode initialization signals GBN+1 through GBN+M that sequentially have the on-level in the first frame period of the partial driving mode and are maintained as the on-level until a driving mode is changed to the normal driving mode.

In the partial driving mode, when the first partial panel region PPR1 is not driven and the second partial panel region PPR2 is driven, the mode control signal MCS may have the off-level, the first diode initialization start signal GB_FLM1 may have the on-level, and the second diode initialization start signal GB_FLM2 may include the diode initialization start pulse in each frame period. In this case, the first through N-th diode initialization stages GB_STG1 through GB_STGN may provide the first through N-th pixel rows PXR1 through PXRN with the first through N-th diode initialization signals GB1 through GBN that sequentially have the on-level in the first frame period of the partial driving mode and are maintained as the on-level until the driving mode is changed to the normal driving mode. The (N+1)-th through (N+M)-th diode initialization stages GB_STGN+1 through GB_STGN+M may sequentially apply the (N+1)-th through (N+M)-th diode initialization signals GBN+1 through GBN+M to the (N+1)-th through (N+M)-th pixel rows PXRN+1 through PXRN+M in each frame period.

Figure 5:
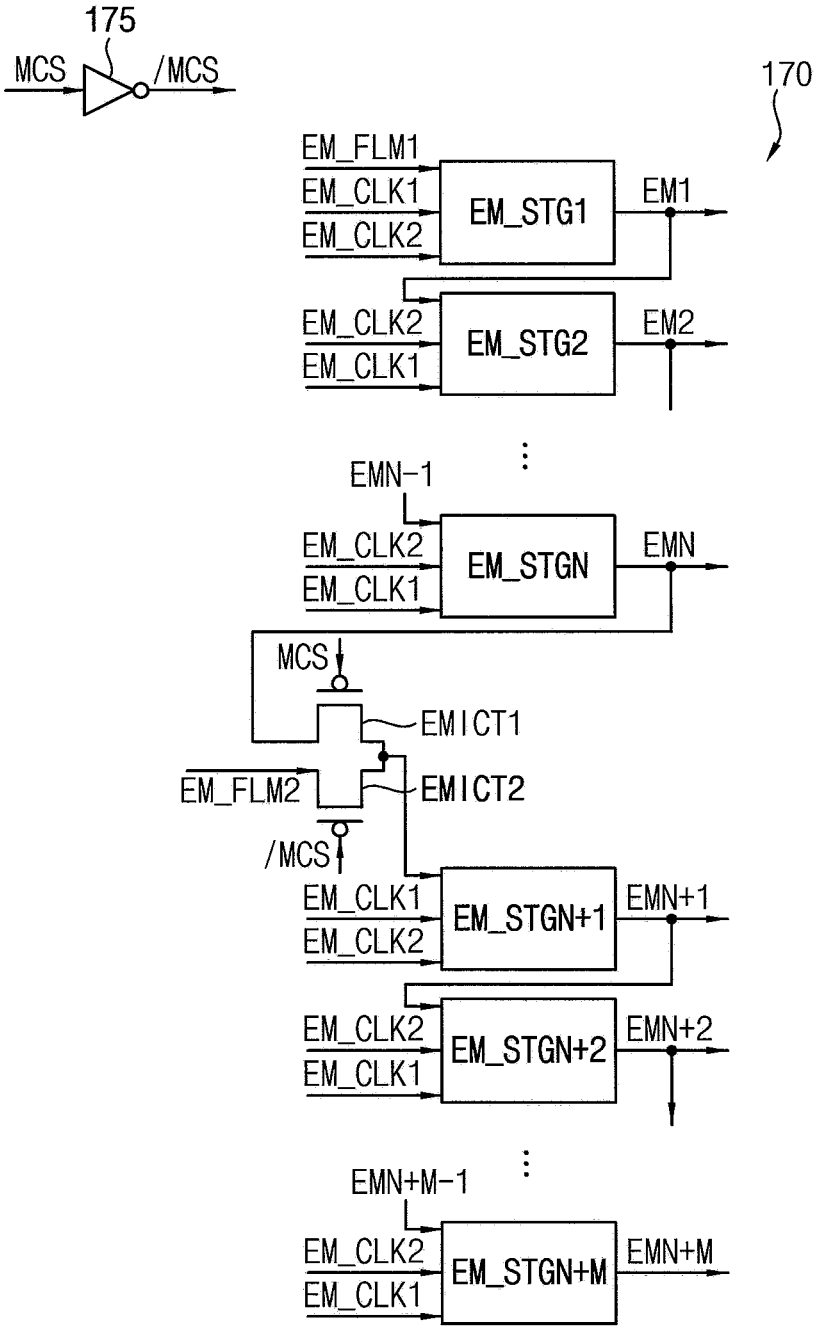
FIG. 5 is a block diagram illustrating an example of an emission driver included in the OLED display device of FIG. 1.
Figure 6:
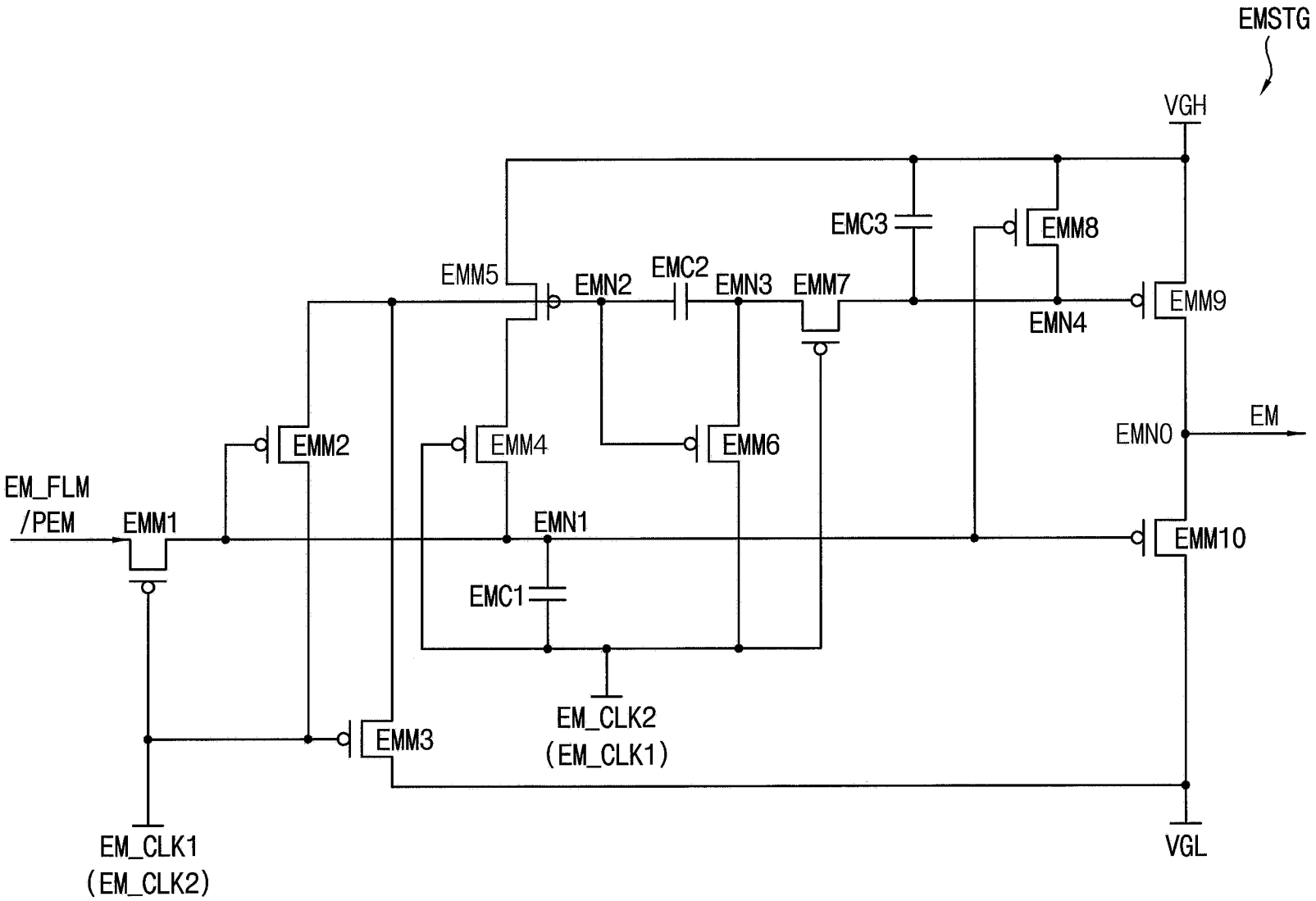
FIG. 6 is a circuit diagram illustrating an example of each stage included in the emission driver of FIG. 5.

FIG. 5 is a block diagram illustrating an example of an emission driver included in the OLED display device of FIG. 1, and FIG. 6 is a circuit diagram illustrating an example of each stage included in the emission driver of FIG. 5.

Referring to FIG. 1 and FIG. 5, an emission driver 170 may include first through (N+M)-th emission control stages EM_STG1 through EM_STGN+M, an emission control input control circuit EMICT1 and EMICT2, and an inverter 175 outputting an inverted mode control signal /MCS.

The first through (N+M)-th emission control stages EM_STG1 through EM_STGN+M may sequentially apply the first through (N+M)-th emission control signals EM1 through EMN+M to first through (N+M)-th pixel rows PXR1 through PXRN+M based on first and second emission control start signals EM_FLM1 and EM_FLM2 and first and second emission control clock signals EM_CLK1 and EM_CLK2. In some example embodiments, the first and second emission control clock signals EM_CLK1 and EM_CLK2 may have opposite phases to each other. In some example embodiments, each odd-numbered emission control stage (e.g., EM_STG1, EM_STGN+1, etc.) may receive the first and second emission control clock signals EM_CLK1 and EM_CLK2 at first and second clock inputs, respectively, and each even-numbered emission control stage (e.g., EM_STG2, EM_STGN, EM_STGN+2, EM_STGN+M, etc.) may receive the second and first emission control clock signals EM_CLK2 and EM_CLK1 at the first and second clock inputs, respectively.

In some example embodiments, as illustrated in FIG. 6, each stage EM_STG of the first through (N+M)-th emission control stages (e.g., EM_STG1 through EM_STGN+M) may include first through tenth transistors EMM1 through EMM10 and first through third capacitors EMC1, EMC2, and EMC3. The first transistor EMM1 may transfer an emission control start signal EM_FLM or a previous emission control signal PEM to a first node EMN1 in response to the first emission control clock signal EM_CLK1. The second transistor EMM2 may transfer the first emission control clock signal EM_CLK1 to a second node EMN2 in response to a voltage of the first node EMN1. The third transistor EMM3 may transfer a low gate voltage VGL to the second node EMN2 in response to the first emission control clock signal EM_CLK1. The fourth and fifth transistors EMM4 and EMM5 may transfer a high gate voltage VGH to the first node EMN1 in response to the second emission control clock signal EM_CLK2 and a voltage of the second node EMN2. The sixth transistor EMM6 may transfer the second emission control clock signal EM_CLK2 to a third node EMN3 in response to the voltage of the second node EMN2. The seventh transistor EMM7 may connect the third node EMN3 and a fourth node EMN4 in response to the second emission control clock signal EM_CLK2. The eighth transistor EMM8 may transfer the high gate voltage VGH to the fourth node EMN4 in response to the voltage of the first node EMN1. The ninth transistor EMM9 may transfer the high gate voltage VGH to an output node EMNO in response to a voltage of the fourth node EMN4. The tenth transistor EMM10 may transfer the low gate voltage VGL as an emission control signal EM to the output node EMNO in response to the voltage of the first node EMN1. The first capacitor EMC1 may be connected between the first node EMN1 and a line of the second emission control clock signal EM_CLK2, the second capacitor EMC2 may be connected between the second node EMN2 and the third node EMN3, and the third capacitor EMC3 may be connected between a line of the high gate voltage VGH and the fourth node EMN4.

Figure 8:
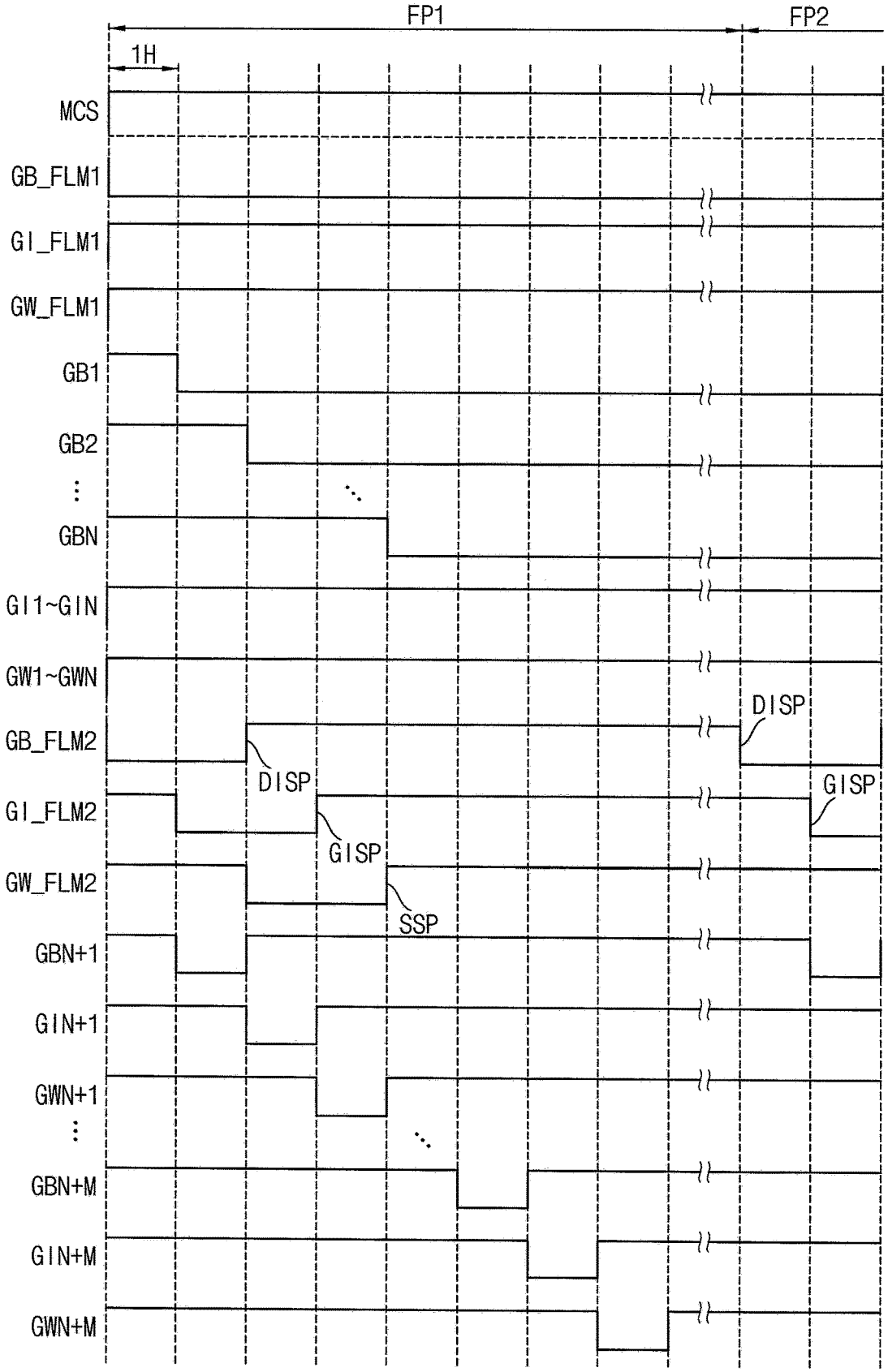
FIG. 8 is a timing diagram for describing an example of an operation of the OLED display device of FIG. 1 in a partial driving mode.

FIG. 7 is a timing diagram for describing an example of an operation of the OLED display device of FIG. 1 in a normal driving mode, and FIG. 8 is a timing diagram for describing an example of an operation of the OLED display device of FIG. 1 in a partial driving mode.

Referring to FIG. 1, FIG. 3, and FIG. 7, in a normal driving mode where both of first and second partial panel regions PPR1 and PPR2 are driven, a mode control signal MCS may have an on-level (e.g., a low level) representing the normal driving mode, a first diode initialization start signal GB_FLM1 may include a diode initialization start pulse DISP in each frame period, a first gate initialization start signal GI_FLM1 may include a gate initialization start pulse GISP in each frame period, and a first scan start signal GW_FLM1 may include a scan start pulse SSP in each frame period. Accordingly, first through (N+M)-th diode initialization signals GB1, GB2, . . . , GBN+M may be sequentially output at each one horizontal time (1H), first through (N+M)-th gate initialization signals GI1 through GIN+M may be sequentially output at each 1H, and first through (N+M)-th scan signals GW1 through GWN+M may be sequentially output at each 1H. Although FIG. 7 illustrates an example where the diode initialization signal (e.g., GB1), the gate initialization signal (e.g., GI1) and the scan signal (e.g., GW1) are sequentially output with respect to each pixel row (e.g., PXR1), the order of the signals may not be limited thereto.

Referring to FIG. 1, FIG. 3, and FIG. 8, in a partial driving mode where the first partial panel region PPR1 is not driven and the second partial panel region PPR2 is driven, the mode control signal MCS may have an off-level (e.g., a high level) representing the partial driving mode, the first diode initialization start signal GB_FLM1 may have the on-level, and the first gate initialization start signal GI_FLM1 and the first scan start signal GW_FLM1 may have the off-level. Based on the first diode initialization start signal GB_FLM1 having the on-level, the first through N-th diode initialization signals GB1, GB2, . . . , GBN may sequentially have the on-level in a first frame period of the partial driving mode, and may be maintained as the on-level until a driving mode is changed to the normal driving mode, or a time period from a second frame period FP2 to the last time period. The first through N-th gate initialization signals GI1 through GIN and the first through N-th scan signals GW1 through GWN may have the off-level.

A second diode initialization start signal GB_FLM2 may include the diode initialization start pulse DISP in each frame period, a second gate initialization start signal GI_FLM2 may include the gate initialization start pulse GISP in each frame period, and a second scan start signal GW_FLM2 may include the scan start pulse SSP in each frame period. Accordingly, the (N+1)-th through (N+M)-th diode initialization signals GBN+1 through GBN+M may be sequentially output at each 1H, the (N+1)-th through (N+M)-th gate initialization signals GIN+1 through GIN+M may be sequentially output at each 1H, and the (N+1)-th through (N+M)-th scan signals GWN+1 through GWN+M may be sequentially output at each 1H.

Figure 9:
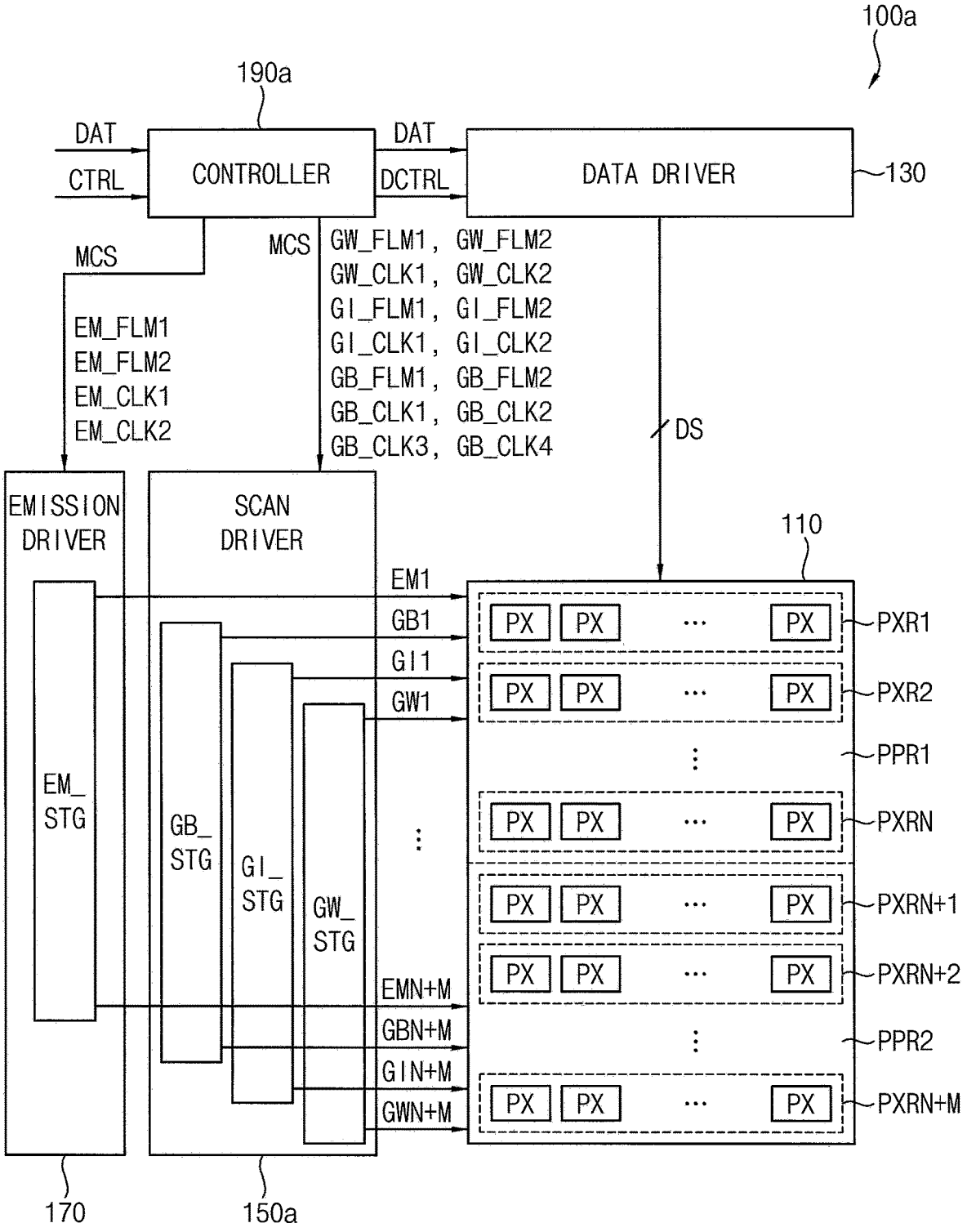
FIG. 9 is a block diagram illustrating an OLED display device according to example embodiments.
Figure 10:
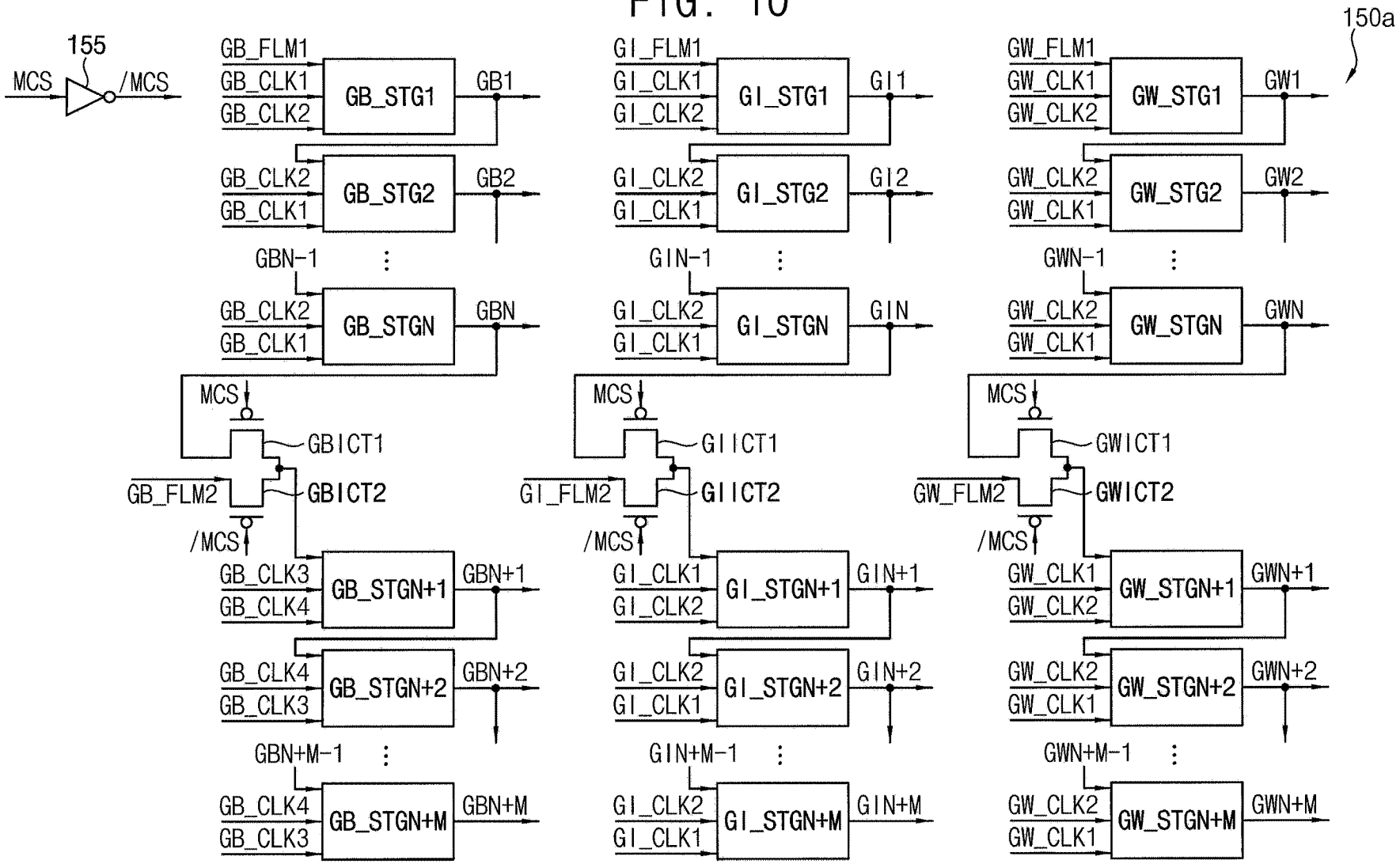
FIG. 10 is a block diagram illustrating an example of a scan driver included in an OLED display device of FIG. 9.
Figure 11:
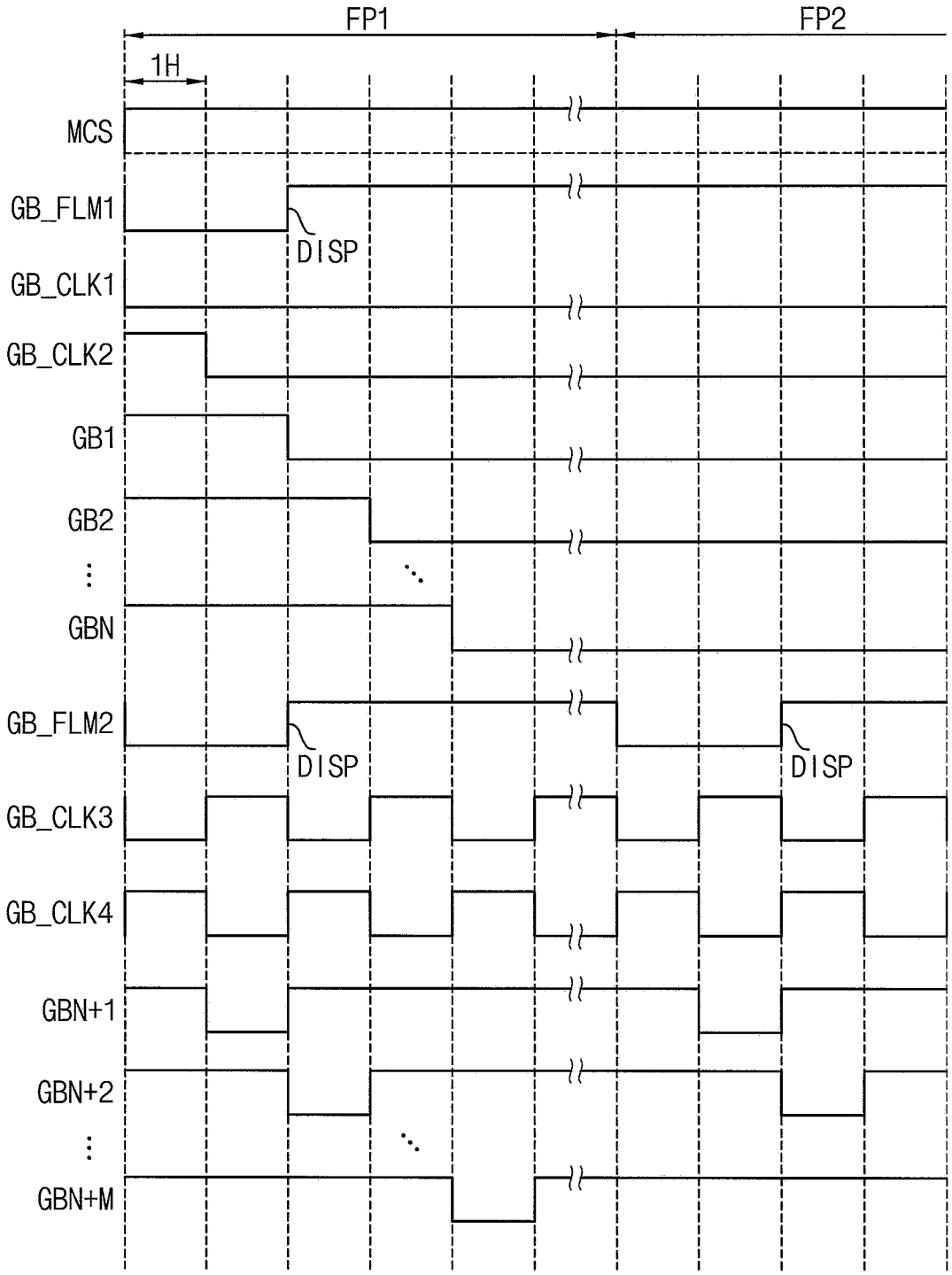
FIG. 11 is a timing diagram for describing an example of an operation of an OLED display device of FIG. 9 in a partial driving mode.

FIG. 9 is a block diagram illustrating an OLED display device according to example embodiments, FIG. 10 is a block diagram illustrating an example of a scan driver included in the OLED display device of FIG. 9, and FIG. 11 is a timing diagram for describing an example of an operation of the OLED display device of FIG. 9 in a partial driving mode.

An OLED display device 100*a* of FIG. 9 may have a similar configuration and a similar operation to an OLED display device 100 of FIG. 1, except that a controller 190*a* may further provide third and fourth diode initialization clock signals GB_CLK3 and GB_CLK4 to a scan driver 150*a*.

Referring to FIG. 9 and FIG. 10, first through N-th diode initialization stages GB_STG1 through GB_STGN may operate in response to first and second diode initialization clock signals GB_CLK1 and GB_CLK2, and (N+1)-th through (N+M)-th diode initialization stages GB_STGN+1 through GB_STGN+M may operate in response to the third and fourth diode initialization clock signals GB_CLK3 and GB_CLK4.

In a normal driving mode, the third diode initialization clock signal GB_CLK3 may have a phase same as a phase of the first diode initialization clock signal GB_CLK1, and the fourth diode initialization clock signal GB_CLK4 may have a phase same as a phase of the second diode initialization clock signal GB_CLK2. Accordingly, the first through (N+M)-th diode initialization stages GB_STG1 through GB_STGN+M may sequentially output first through (N+M)-th diode initialization signals GB1 through GBN+M to first through (N+M)-th pixel rows PXR1 through PXRN+M.

In a partial driving mode where a first partial panel region PPR1 is not driven and a second partial panel region PPR2 is driven, as illustrated in FIG. 11, the first and second diode initialization clock signals GB_CLK1 and GB_CLK2 may have an on-level, and a first diode initialization start signal GB_FLM1 may include a diode initialization start pulse DISP in a first frame period FP1 of the partial driving mode. In response to the first diode initialization start signal GB_FLM1 and the first and second diode initialization clock signals GB_CLK1 and GB_CLK2 having the on-level, the first through N-th diode initialization stages GB_STG1 through GB_STGN may provide the first through N-th pixel rows PXR1 through PXRN with the first through N-th diode initialization signals GB1, GB2, . . . , GBN that sequentially have the on-level in the first frame period FP1 of the partial driving mode and are maintained as the on-level until a driving mode is changed to the normal driving mode.

The third and fourth diode initialization clock signals GB_CLK3 and GB_CLK4 may periodically toggle between the on-level and an off-level, and a second diode initialization start signal GB_FLM2 may include the diode initialization start pulse DISP in each frame period. Accordingly, the (N+1)-th through (N+M)-th diode initialization stages GB_STGN+1 through GB_STGN+M may sequentially output the (N+1)-th through (N+M)-th diode initialization signals GBN+1 through GBN+M to the (N+1)-th through (N+M)-th pixel rows PXRN+1 through PXRN+M.

In a partial driving mode where the first partial panel region PPR1 is driven and the second partial panel region PPR2 is not driven, the first and second diode initialization clock signals GB_CLK1 and GB_CLK2 may periodically toggle between the on-level and the off-level, the third and fourth diode initialization clock signals GB_CLK3 and GB_CLK4 may have the on-level, the first diode initialization start signal GB_FLM1 may include the diode initialization start pulse DISP in each frame period, and the second diode initialization start signal GB_FLM2 may include the diode initialization start pulse DISP in the first frame period FP1 of the partial driving mode. Accordingly, the first through N-th diode initialization stages GB_STG1 through GB_STGN may sequentially output the first through N-th diode initialization signals GB1 through GBN to the first through N-th pixel rows PXR1 through PXRN, and the (N+1)-th through (N+M)-th diode initialization stages GB_STGN+1 through GB_STGN+M may provide the (N+1)-th through (N+M)-th pixel rows PXRN+1 through PXRN+M with the (N+1)-th through (N+M)-th diode initialization signals GBN+1 through GBN+M that sequentially have the on-level in the first frame period FP1 of the partial driving mode and are maintained as the on-level until the driving mode is changed to the normal driving mode.

Figure 12:
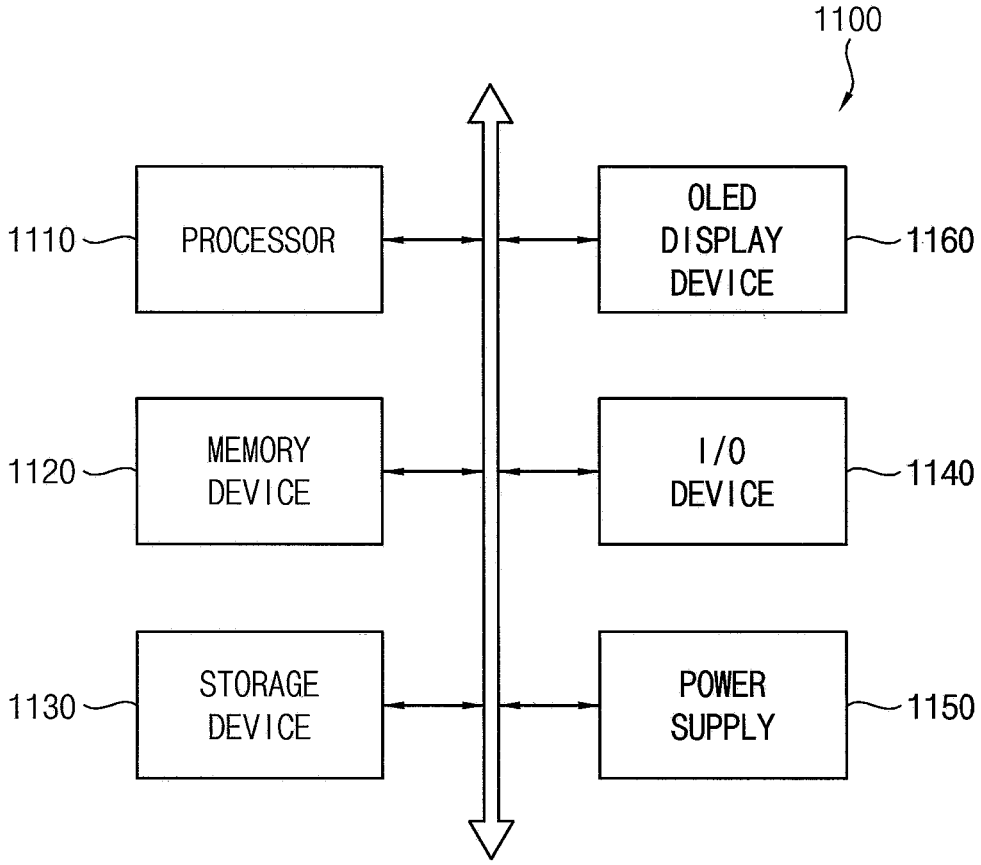
FIG. 12 is a block diagram illustrating an electronic device including a display device according to example embodiments.

FIG. 12 is a block diagram illustrating an electronic device including a display device according to example embodiments.

Referring to FIG. 12, an electronic device 1100 may include a processor 1110, a memory device 1120, a storage device 1130, an input/output (I/O) device 1140, a power supply 1150, and an OLED display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro-processor, a central processing unit (CPU), etc. The processor 1110 may be coupled to other components via an address bus, a control bus, a data bus, etc. Further, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and/or an output device such as a printer, a speaker, etc. The power supply 1150 may supply power for operations of the electronic device 1100.

The OLED display device 1160 may concurrently (e.g., simultaneously) apply diode initialization signals to a partial panel region that is not driven in a partial driving mode, thereby forming, in pixels of the non-driven partial panel region, discharge paths for discharging parasitic capacitors of OLEDs and leakage current paths where leakage currents of driving transistors flow. Accordingly, the non-driven partial panel region may be prevented or reduced from undesirably emitting light.

In some example embodiments, the electronic device 1100 be any electronic device including the OLED display device 1160, such as a cellular phone, a smart phone, a tablet computer, a wearable device, a virtual reality (VR) device, a personal digital assistant (PDA), a portable multimedia player (PMP), a digital camera, a music player, a portable game console, a navigation system, a digital television, a 3D television, a personal computer (PC), a home appliance, a laptop computer, etc.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing aspects of some example embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present invention". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. An organic light emitting diode (OLED) display device comprising:

a display panel comprising a first partial panel region and a second partial panel region;

a scan driver configured to sequentially apply scan signals to the first and second partial panel regions in a normal driving mode where both of the first and second partial panel regions are driven, and to sequentially apply the scan signals to a driven one of the first and second partial panel regions in a partial driving mode, wherein the driven one of the first and second partial panel regions is driven and a non-driven one of the first and second partial panel regions is not driven; and a data driver configured to apply data signals to the first and second partial panel regions in the normal driving mode, and to apply the data signals to the driven one of the first and second partial panel regions in the partial driving mode, wherein, in the partial driving mode, the scan driver is configured to sequentially apply diode initialization signals to the driven one of the first and second partial panel regions, and to concurrently apply the diode initialization signals to the non-driven one of the first and second partial panel regions.

2. The OLED display device of claim 1, wherein, in the partial driving mode, OLEDs of pixels included in the non-driven one of the first and second partial panel regions are initialized in response to the concurrently applied diode initialization signals.

3. The OLED display device of claim 1, wherein, in the partial driving mode, pixels included in the non-driven one of the first and second partial panel regions form leakage current paths from a power supply voltage line to an initialization voltage line in response to the concurrently applied diode initialization signals.

4. The OLED display device of claim 1, wherein each of the first and second partial panel regions comprises a plurality of pixels, wherein each of the plurality of pixels comprises a diode initialization transistor having a gate for receiving a corresponding one of the diode initialization signals, a first terminal connected to an initialization voltage line, and a second terminal connected to an anode of an OLED, and wherein, in the partial driving mode, the diode initialization transistors of the plurality of pixels included in the non-driven one of the first and second partial panel regions are turned on in response to the concurrently applied diode initialization signals.

5. The OLED display device of claim 4, wherein the turned-on diode initialization transistors of the plurality of pixels included in the non-driven one of the first and second partial panel regions form discharge paths for discharging parasitic capacitors of OLEDs of the plurality of pixels included in the non-driven one of the first and second partial panel regions to the initialization voltage line, and form leakage current paths for allowing leakage currents of driving transistors to flow to the initialization voltage line.

6. The OLED display device of claim 1, wherein, in the partial driving mode, the diode initialization signals applied to the non-driven one of the first and second partial panel regions concurrently have an on-level for at least one horizontal time.

7. The OLED display device of claim 1, wherein, in the partial driving mode, the diode initialization signals applied to the non-driven one of the first and second partial panel regions sequentially have an on-level in a first frame period of the partial driving mode, and are maintained as the on-level until a driving mode of the OLED display device is changed to the normal driving mode.

8. The OLED display device of claim 1, wherein the first partial panel region comprises first through N-th pixel rows, the second partial panel region comprises (N+1)-th through (N+M)-th pixel rows, and the scan signals comprises first through (N+M)-th scan signals, wherein each of N and M is an integer greater than 1, and wherein the scan driver comprises:

a first scan stage configured to apply the first scan signal to the first pixel row in response to a first scan start signal;

second through N-th scan stages configured to apply the second through N-th scan signals to the second through N-th pixel rows in response to the first through (N−1)-th scan signals;

a scan input control circuit configured to selectively output a second scan start signal or the N-th scan signal in response to a mode control signal;

an (N+1)-th scan stage configured to apply the (N+1)-th scan signal to the (N+1)-th pixel row in response to an output signal of the scan input control circuit; and (N+2)-th through (N+M)-th scan stages configured to apply the (N+2)-th through (N+M)-th scan signals to the (N+2)-th through (N+M)-th pixel rows in response to the (N+1)-th through (N+M−1)-th scan signals.

9. The OLED display device of claim 8, wherein the scan input control circuit comprises:

a first scan input control transistor configured to output the N-th scan signal received from the N-th scan stage in response to the mode control signal having an on-level in the normal driving mode; and a second scan input control transistor configured to output the second scan start signal in response to an inverted mode control signal having the on-level in the partial driving mode.

10. The OLED display device of claim 8, wherein, in the normal driving mode, the mode control signal has an on-level, the first scan start signal comprises a scan start pulse in each frame period, and the second scan start signal has an off-level, wherein, in the partial driving mode, when the first partial panel region is driven and the second partial panel region is not driven, the mode control signal has the off-level, the first scan start signal comprises the scan start pulse in each frame period, and the second scan start signal has the off-level, and wherein, in the partial driving mode, when the first partial panel region is not driven and the second partial panel region is driven, the mode control signal has the off-level, the first scan start signal has the off-level, and the second scan start signal comprises the scan start pulse in each frame period.

11. The OLED display device of claim 1, wherein the first partial panel region comprises first through N-th pixel rows, the second partial panel region comprises (N+1)-th through (N+M)-th pixel rows, and the diode initialization signals comprises first through (N+M)-th diode initialization signals, wherein each of N and M is an integer greater than 1, and wherein the scan driver comprises:

a first diode initialization stage configured to apply the first diode initialization signal to the first pixel row in response to a first diode initialization start signal;

second through N-th diode initialization stages configured to apply the second through N-th diode initialization signals to the second through N-th pixel rows in response to the first through (N−1)-th diode initialization signals;

a diode initialization input control circuit configured to selectively output a second diode initialization start signal or the N-th diode initialization signal in response to a mode control signal;

an (N+1)-th diode initialization stage configured to apply the (N+1)-th diode initialization signal to the (N+1)-th pixel row in response to an output signal of the diode initialization input control circuit; and (N+2)-th through (N+M)-th diode initialization stages configured to apply the (N+2)-th through (N+M)-th diode initialization signals to the (N+2)-th through (N+M)-th pixel rows in response to the (N+1)-th through (N+M−1)-th diode initialization signals.

12. The OLED display device of claim 11, wherein the diode initialization input control circuit comprises:

a first diode initialization input control transistor configured to output the N-th diode initialization signal received from the N-th diode initialization stage in response to the mode control signal having an on-level in the normal driving mode; and a second diode initialization input control transistor configured to output the second diode initialization start signal in response to an inverted mode control signal having the on-level in the partial driving mode.

13. The OLED display device of claim 11, wherein, in the normal driving mode, the mode control signal has an on-level, the first diode initialization start signal comprises a diode initialization start pulse in each frame period, and the second diode initialization start signal has an off-level, wherein, in the partial driving mode, when the first partial panel region is driven and the second partial panel region is not driven, the mode control signal has the off-level, the first diode initialization start signal comprises the diode initialization start pulse in each frame period, and the second diode initialization start signal has the on-level, and wherein, in the partial driving mode, when the first partial panel region is not driven and the second partial panel region is driven, the mode control signal has the off-level, the first diode initialization start signal has the on-level, and the second diode initialization start signal comprises the diode initialization start pulse in each frame period.

14. The OLED display device of claim 11, wherein the first through N-th diode initialization stages operate in response to first and second diode initialization clock signals, and the (N+1)-th through (N+M)-th diode initialization stages operate in response to third and fourth diode initialization clock signals, wherein, in the normal driving mode, the first and second diode initialization clock signals have same phases as those of the third and fourth diode initialization clock signals, respectively, wherein, in the partial driving mode, when the first partial panel region is driven and the second partial panel region is not driven, the first and second diode initialization clock signals periodically toggle between an on-level and an off-level, the third and fourth diode initialization clock signals have the on-level, and the second diode initialization start signal comprises a diode initialization start pulse in a first frame period of the partial driving mode, and wherein, in the partial driving mode, when the first partial panel region is not driven and the second partial panel region is driven, the first and second diode initialization clock signals have the on-level, the third and fourth diode initialization clock signals periodically toggle between the on-level and the off-level, and the first diode initialization start signal comprises the diode initialization start pulse in the first frame period of the partial driving mode.

15. An organic light emitting diode (OLED) display device comprising:

a display panel comprising a first partial panel region comprising first through N-th pixel rows and a second partial panel region comprising (N+1)-th through (N+M)-th pixel rows, wherein each of N and M is an integer greater than 1;

a scan driver configured to sequentially apply scan signals to the first through (N+M)-th pixel rows in a normal driving mode where both of the first and second partial panel regions are driven, and to sequentially apply the scan signals to the (N+1)-th through (N+M)-th pixel rows in a partial driving mode where the first partial panel region is not driven and the second partial panel region is driven; and a data driver configured to apply data signals to the first through (N+M)-th pixel rows in the normal driving mode, and to apply the data signals to the (N+1)-th through (N+M)-th pixel rows in the partial driving mode where the first partial panel region is not driven and the second partial panel region is driven, wherein, in the normal driving mode, the scan driver is configured to sequentially apply diode initialization signals to the first through (N+M)-th pixel rows, and wherein, in the partial driving mode where the first partial panel region is not driven and the second partial panel region is driven, the scan driver is configured to sequentially apply the diode initialization signals to the (N+1)-th through (N+M)-th pixel rows, and to concurrently apply the diode initialization signals to the first through N-th pixel rows.

16. The OLED display device of claim 15, wherein, in the partial driving mode where the first partial panel region is not driven and the second partial panel region is driven, the scan signals and the data signals are not applied to the first through N-th pixel rows.

17. The OLED display device of claim 15, wherein, in the partial driving mode where the first partial panel region is not driven and the second partial panel region is driven, OLEDs of pixels included in the first partial panel region are initialized in response to the concurrently applied diode initialization signals.

18. The OLED display device of claim 15, wherein, in the partial driving mode where the first partial panel region is not driven and the second partial panel region is driven, pixels included in the first partial panel region form leakage current paths from a power supply voltage line to an initialization voltage line in response to the concurrently applied diode initialization signals.

19. The OLED display device of claim 15, wherein, in the partial driving mode where the first partial panel region is not driven and the second partial panel region is driven, the diode initialization signals applied to first partial panel region sequentially have an on-level in a first frame period of the partial driving mode, and are maintained as the on-level until a driving mode of the OLED display device is changed to the normal driving mode.

20. The OLED display device of claim 15, wherein, in the partial driving mode where the first partial panel region is driven and the second partial panel region is not driven, the scan driver sequentially applies the diode initialization signals to the first through N-th pixel rows, and concurrently applies the diode initialization signals to the (N+1)-th through (N+M)-th pixel rows.

* * * * *